US007878124B2

(12) United States Patent
Low et al.

(10) Patent No.: US 7,878,124 B2
(45) Date of Patent: Feb. 1, 2011

(54) SEMI-RIGID RAILCAR COVER

(75) Inventors: Trevor Low, North Vancouver (CA); Mark Doldon, North Vancouver (CA); John Cruikshank, Brisbane (AU)

(73) Assignee: Ecofab Covers International Inc., Bridgetown (BB)

( * ) Notice: Subject to any disclaimer, the term of this patent is extended or adjusted under 35 U.S.C. 154(b) by 0 days.

(21) Appl. No.: 12/038,348

(22) Filed: Feb. 27, 2008

(65) Prior Publication Data

US 2008/0236439 A1 Oct. 2, 2008

Related U.S. Application Data

(60) Provisional application No. 60/891,724, filed on Feb. 27, 2007.

(51) Int. Cl.
*B61D 39/00* (2006.01)
*B61D 17/12* (2006.01)

(52) U.S. Cl. ..... 105/377.05; 105/377.03; 105/377.04; 105/377.06; 105/377.11; 296/100.1

(58) Field of Classification Search ... 105/241.1–241.2, 105/377.01–377.06, 377.11; 52/45; 296/100.01, 296/100.06, 100.15, 100.17, 100.18; 220/810, 220/817
See application file for complete search history.

(56) References Cited

U.S. PATENT DOCUMENTS

| | | | | |
|---|---|---|---|---|
| 1,747,423 | A | 2/1930 | Campbell | |
| 3,461,818 | A | 8/1969 | Sanders et al. | |
| 3,583,334 | A | 6/1971 | Schuller | |
| 3,587,476 | A | 6/1971 | Ingram | |
| 3,631,816 | A | 1/1972 | Miller | |
| 3,677,196 | A | 7/1972 | Schuller | |
| 3,796,168 | A | 3/1974 | Zeller | |
| 3,831,792 | A | 8/1974 | Waterman et al. | |
| 3,994,240 | A | 11/1976 | Berg et al. | |
| 4,218,087 | A | 8/1980 | Neville | |
| 4,239,008 | A | 12/1980 | Conlon | |
| 4,299,174 | A | 11/1981 | Piester | |
| 4,368,674 | A | 1/1983 | Wiens et al. | |
| 4,452,150 | A | 6/1984 | Dominguez | |
| 4,524,700 | A | 6/1985 | Engdahl | |
| 4,613,174 | A | 9/1986 | Berg et al. | |
| 4,821,648 | A | 4/1989 | Bramhall et al. | |
| 4,961,387 | A | 10/1990 | Kneebone et al. | |
| 5,054,402 | A | 10/1991 | Brassell | |
| 5,311,824 | A | 5/1994 | Sauer et al. | |
| 5,355,808 | A | 10/1994 | Early | |
| 5,487,584 | A * | 1/1996 | Jespersen | 296/100.18 |

(Continued)

FOREIGN PATENT DOCUMENTS

| | | |
|---|---|---|
| CA | 896979 | 4/1972 |

(Continued)

*Primary Examiner*—S. Joseph Morano
*Assistant Examiner*—Zachary Kuhfuss
(74) *Attorney, Agent, or Firm*—Stephen R. Burri

(57) ABSTRACT

A cover for open top railcars may be alternatively locked into place over the railcar top opening, or rotated on hinges to either side of the railcar to provide access to the entire top of the railcar. The cover may be compressed against either side of the railcar to allow the car to move between structural or other elements of loading or unloading facilities.

34 Claims, 22 Drawing Sheets

U.S. PATENT DOCUMENTS 5,572,932 A 11/1996 Early
5,664,824 A * 9/1997 Stephens et al. ..... 296/100.17
6,092,471 A 7/2000 Early
6,827,025 B2 12/2004 Gaydos et al.
6,983,975 B2 * 1/2006 Morrow ..... 296/100.1
7,003,850 B2 2/2006 Gaydos et al.

FOREIGN PATENT DOCUMENTS

GB 265063 2/1927

* cited by examiner

SEMI-RIGID RAILCAR COVER

RELATIONSHIP TO PREVIOUS APPLICATIONS

The present invention claims priority from U.S. Provisional Patent Application No. 60,891,724 filed Feb. 27, 2007.

FIELD OF THE INVENTION

The present invention relates to railcar covers. In particular, the present invention relates to unitary, semi-rigid, deformable covers for open top railcars.

BACKGROUND OF THE INVENTION

It is known to provide open topped railway cars, whether bottom dump hoppers or top unloading gondolas, which may be fitted with removable covers to enclose the top opening. These covers typically may be lifted free of the cars for loading, or, in the case of gondolas, for unloading. Once a load has been loaded or unloaded, the cover may be replaced.

Such covers provide a number of benefits, including product containment, for example, prevention of ingress of dust, which represents an environmental hazard, and prevention of product loss, and product protection, for example, protection from rain or snow, and protection from debris. Many different granular or powder products may be shipped in this way, including minerals, grains, hazardous waste, coal, etc.

Typically, covers are fastened onto railcars by the use of various types of clamps or brackets, which fix the cover to the car and prevent it from coming loose in transit, but which allow manual or automatic opening in order to handle the cover.

Covers typically may be manufactured of steel, aluminum, or various composite materials, each of which has it's advantages and disadvantages. Covers may be built as a single piece covering the full length and width of the railcar, or as two or more pieces, depending on the material selected and the circumstances of operation. Due to their large size, railcar covers require heavy equipment, whether fixed or mobile, for removal and replacement, as well as large areas for moving and stacking removed covers.

The weight of each cover can be significant, ranging from as little as 1500 lbs for a composite cover, to as much as 5000 lbs for a steel cover. The cover weight reduces the effective payload of the railcar, thereby reducing the cargo load the user can haul.

In high volume situations, it is often not possible to arrange a suitable method for removal and replacement of covers. For instance, in a coal loading facility, the railcars typically do not stop moving, but are driven slowly in one long string through the facility, under loading chutes, and exit the far side of the loading facility, which may be several hundred feet away. Slowing or stopping of trains is generally not an option. The logistics of lifting covers off at the entrance to the facility, moving them around the facility to the loadout area at the loading facility exit, and replacing the covers on the railcars, make use of covers very problematic. As a result, to date, no large scale loading operations of this type have been converted to covered cars.

On the unloading end, the problem is similar. For unloading gondola type railcars, high volume operations such as coal will use a railcar dumper, a large device which rotates about the axis of the railcar couplers, completely inverting one or more railcars at a time, while they remain coupled to the cars ahead and behind. Again, covers would have to be removed from cars entering the dumper building, moved around the building, and replaced on the other side.

Past and current solutions have included lifting of covers within the dumper building over the dumper itself. This adds time to the dump cycle, and is not suitable for retrofit situations, as dumper buildings typically do not have the space capacity for such a cover lifting mechanism, and many dumpers are constructed with part of their mechanism over top of the car, which would prevent removal of the railcar cover. This solution also would not work at the loading end. Accordingly, a new cover removal system is needed.

SUMMARY OF THE INVENTION

In one aspect of a preferred embodiment of the present invention, there is provided a cover assembly for a railcar of the type having a top opening, first and second sides and first and second side sills, the cover assembly comprising a cover having opposed side edges, wherein the cover may be rotatable through an arc of up to 270 degrees about either side edge between a closed position atop the railcar and an open position alongside a corresponding side of the railcar.

The cover may be manufactured of a semi-rigid, deformable main cover section, and a pair of rigid end sections, each end section hingedly attached to opposing ends of the main cover section. The cover assembly may have means for reversibly opening the cover.

Each end section may have a planar element having first and second faces, a straight edge and a parabolic edge, at least two oblong hollow cylindrical guide elements fixedly attached in spaced apart relationship to the first face of the planar element, a pair of elongated first and second tubes, the first tube hingedly connected at a first end to an edge of one end of the main cover and in telescopic relationship with a first end of a second tube, the second end of the second tube hingedly connected to a corresponding opposite edge of the corresponding end of the main cover; and a pair of guide collars, each collar attached to a tube for guiding the sliding motion of a corresponding guide element across a corresponding tube. Maximum rotation of the cover may guide each end section into a co-planar alignment with the main cover section.

The cover assembly may have at least one first side hinge, each first side hinge comprising a cover sub-assembly and a car sub-assembly, wherein the car sub-assembly may be attached to the first side top sill of the railcar for releasably and rotationally engaging the cover sub-assembly on a corresponding side of the cover. There may be at least one second side hinge, each second side hinge comprising a cover sub-assembly and a car sub-assembly, wherein the car sub-assembly may be attached to the second side top sill of the railcar for releasably and rotationally engaging the cover sub-assembly on a corresponding second side of the cover.

The cover, in its fully open position, may be compressed towards the side of the railcar. In its fully closed position, the cover may form a dome over the top opening.

Each cover sub-assembly may comprise a plate for attaching the cover sub-assembly to the cover; a selectively shaped hinge arm having first and second ends, the hinge arm connected perpendicularly from a first end to the plate; and a hinge rod connected at a medial position to the second end of the hinge arm.

Each car sub-assembly may comprise a hinge arm receptacle having a pair of selectively shaped adjacent side plates for guiding the hinge rod one or more grooves formed in the side plates, wherein each groove may have an external portion for releasably retaining the cover sub-assembly at the disengaging side edge of the cover during opening and closing of the cover; and an internal portion for receiving the hinge rod into a locking position for cover rotation at the non-disengaging side edge of the cover during opening and closing of the cover.

The cover assembly may further comprise a locking element having a pivoting end and a flared end, pivotal between a locking position in which the flared end is positioned adjacent the groove opening, and an unlocking position in which the flared end is positioned clear of the groove opening.

In an alternate embodiment of the present invention, there is provided a railcar cover assembly in which the cover may have corrugated end sections manufactured of flexible laminate composite material.

In a further embodiment, the hinges may have a cover component comprising a pair of bolting plates for attaching the cover component to the cover; a pair of selectively shaped hinge arms having first and second ends, each hinge arm connected perpendicularly from a first end to a corresponding bolting plate; and a spanning bar having opposing ends, each end connected to a second end of a corresponding hinge arm; and a car component comprising a guiding block having a pair of selectively shaped adjacent side plates for guiding the spanning bar of the cover component into a groove formed in the guiding block, wherein the groove has a first external portion for releasably retaining the cover component at the disengaging side edge of the cover during opening and closing of the cover; and a second internal portion for permitting movement of the spanning bar into a position for cover rotation at the non-disengaging side edge of the cover during opening and closing of the cover. The hinge may have a spring loaded pin attached to the cover component which, in a closed position, secures the cover in the hinge and, in an open position, permits the cover to move upward out of the hinge.

In another of its aspects, the present invention provides a cover system for open top railcars, comprising a semi-rigid, deformable cover for a railcar; and means for reversibly opening the cover. The means for reversibly opening the cover may comprise at least one mechanical arm connected to at least one side edge of the cover, each arm movable between a retracted position and an extracted position and having a spring-loaded catch; means for extracting each mechanical arm; a track for permitting directional movement of the railcar; a stationary helix apparatus adjacent the track for engaging each mechanical arm; and means for retracting each mechanical arm.

The at least one mechanical arm may further comprise a hollow elevator arm, having a longitudinal slot, pivotally connected at a first end to the cover; a shuttle arm slidably engaged at a first end within the second end of the elevator arm; a block connected to a second end of the shuttle arm for engagement with the helix apparatus; a support arm pivotally attached at a first end to the cover and pivotally attached at a second end to the first end of the shuttle arm; and a hinge guide lever attached at a first end to the support arm and at a second end to a projection on the cylindrical rod of the cover sub-assembly of the hinge.

The means for extracting each mechanical arm may comprise a hook on each mechanical arm; at least one U-shaped arm extraction apparatus for engagement of each hook to effect outward movement of each mechanical arm from a retracted position to an extracted position; and a radio frequency identification sensor on the helix apparatus and a radio frequency identification tag on the cover for activation of the arm extraction apparatus.

The helix apparatus may comprise a capture segment; a cover opening segment having entry and exit ends; a guide segment; a cover closing segment having entry and exit ends; and a release segment.

The cover opening segment may further comprise at least one helical tube for engaging the at least one mechanical arm, wherein each helical tube has an entry end and a slot extending along its length and is selectively shaped on the basis of cover geometry, railcar geometry, railcar speed, and available operating space to permit full opening of the cover.

The cover closing segment may further comprise at least one helical tube for engaging the at least one mechanical arm, wherein each helical tube has an exit end and a slot extending along its length and is selectively shaped on the basis of cover geometry, railcar geometry, railcar speed, and available operating space to permit full closing of the cover.

There may be only one helical tube of the cover opening segment and there may be only one helical tube of the cover closing segment. In such case, the guide segment may further comprise a planar guide extending between the tube of the cover opening segment and the tube of the cover closing segment, a portion of the planar guide at a vertical height sufficient to engage either the block of the shuttle arm or a lower edge of the cover to retain the cover within a desired distance of the side of the railcar.

There may be two helical tubes which are parallel in each of the cover opening segment and cover closing segment. In such case, the guide segment further may comprise a planar guide extending between each tube of the cover opening segment and a corresponding tube of the cover closing segment, a portion of the planar guide at a vertical height sufficient to engage a lower edge of the cover and retain the cover within a desired distance of the side of the railcar, the guide having a first opening therein in proximity to the exit end of the cover opening segment, the opening spanned by a first gate, the gate selectively operable to permit passage through the first opening of at least one shuttle arm; and a second opening therein in proximity to the entry end of the cover closing segment, the opening spanned by a second gate, the gate selectively operable to permit passage through the second opening of at least one shuttle arm.

The capture segment may further comprise a flared section at the entry end of each tube for guiding the block of the shuttle arm into the tube.

The means for retracting each mechanical arm may comprise a cover deflection device on the helix apparatus for aligning the cover with each hinge and each simple hinge prior to release of the at least one mechanical arm; and a trigger arm for depressing each spring-loaded catch to effect retraction of each arm into the retracted position.

The release segment may further comprise a flared section at the distal end of each tube for guiding the shuttle out of the tube.

In another aspect of a preferred embodiment of the present invention, a method for reversibly opening a semi-rigid, deformable cover for an open top railcar using the helix apparatus described above may comprise an opening series of steps of moving the railcar along a track to a helix apparatus entry position to effect engagement of the at least one mechanical arm on a first side edge of the cover by each helical tube of the cover opening segment, moving the railcar further along the track to effect de-latching of the cover from the hinges on a first side sill of the railcar, and moving the railcar further along the track to effect rotation of the cover by at least 90 degrees about a second side edge from a closed position atop the railcar, to a partially open position clear of the railcar opening; and a closing series of steps of moving the railcar further along the track to effect reverse rotation of the cover about the second side edge from the partially open position clear of the railcar opening to a closed position atop the railcar, moving the railcar further along the track to effect latching of the cover to the hinges on the first side sill of the railcar, and moving the railcar further along the track to a helix exit position to effect disengagement of the at least one mechanical arm on the first side edge of the cover from each helical tube of the cover closing segment.

The method for reversibly opening a semi-rigid, deformable cover may further comprise the additional final step in the opening series of steps of moving the railcar further along the track to effect rotation of the cover about the second side edge from a partially open position clear of the railcar opening to a fully open position alongside the railcar; and the additional first step in the closing series of steps of moving the railcar further along the track to effect reverse rotation of the cover about the second side edge from the fully open position alongside the railcar to the partially open position clear of the railcar opening.

The method for reversibly opening a semi-rigid, deformable cover may further comprise the additional final step in the opening series of steps of moving the railcar further along the track along a deforming apparatus to effect transition of the cover from an arched formation alongside the railcar to a compressed formation alongside the railcar; and the additional first step in the closing series of steps of moving the railcar further along the track beyond a deforming apparatus to effect transition of the cover from a compressed formation alongside the railcar to an arched formation alongside the railcar.

The method for reversibly opening a semi-rigid, deformable cover may further comprise the additional final step in the opening series of steps of moving the railcar further along the track to a helix exit position to effect disengagement of each mechanical arm on the first side edge of the cover from each corresponding helical tube of the cover opening segment; and the additional first step in the closing series of steps of moving the railcar further along the track to a helix entry position to effect engagement of each mechanical arm on a first side edge of the cover by each corresponding helical tube of the cover closing segment.

The method for reversibly opening a semi-rigid, deformable cover may further comprise the additional step of moving the railcar further along the track alongside the planar guide to maintain the rotational position of the cover during loading or unloading of the railcar.

The method for reversibly opening a semi-rigid, deformable cover may further comprise the additional step of steps of loading the railcar between the cover opening series of steps and the cover closing series of steps.

The method for reversibly opening a semi-rigid, deformable cover may further comprise the additional step of steps of unloading the railcar between the cover opening series of steps and the cover closing series of steps.

BRIEF DESCRIPTION OF THE DRAWINGS

A detailed description of the preferred embodiments is provided below by way of example only and with reference to the following drawings, in which.

Figure 1:
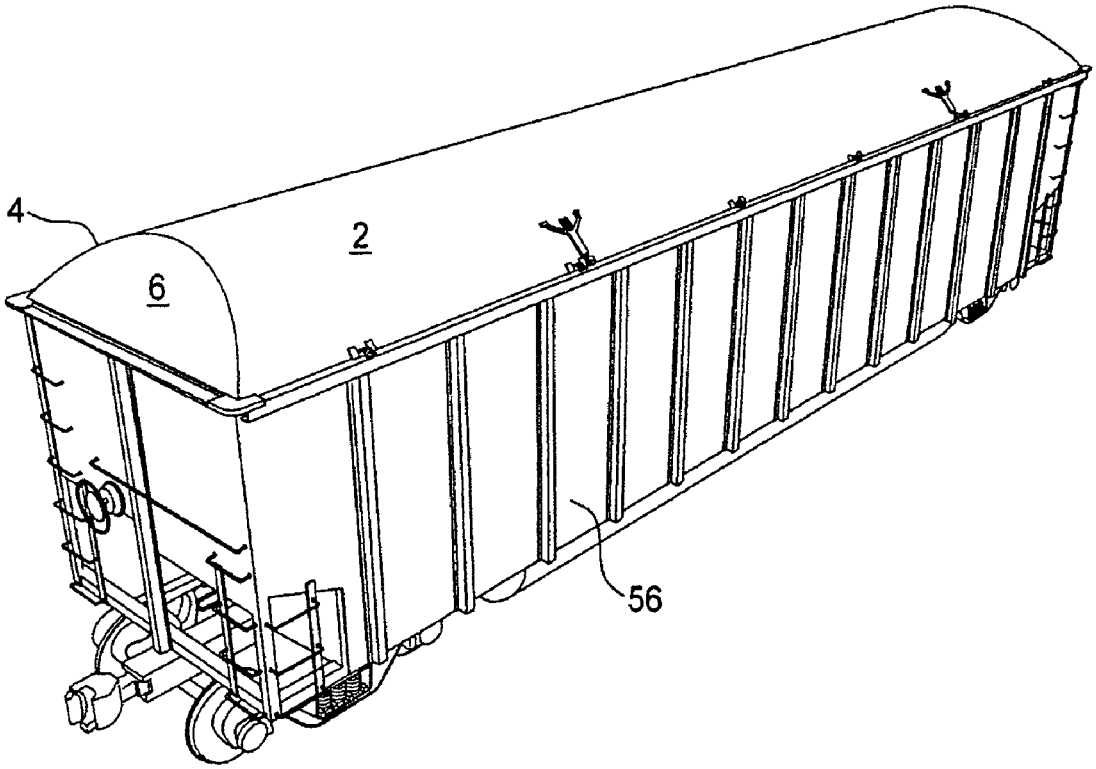
FIG. 1 is a perspective view of the cover in a closed position atop a railcar, according to a preferred embodiment of the invention.
Figure 2:
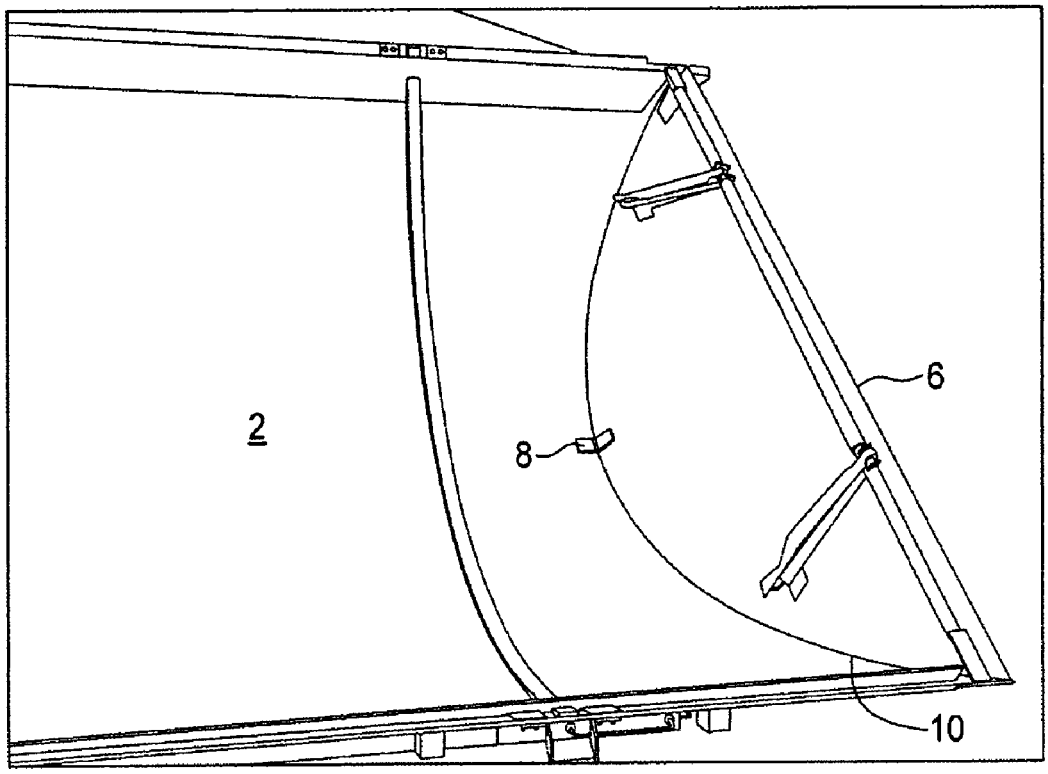
FIG. 2 is a perspective view of the cover in a partially open position beside a railcar, according to a preferred embodiment of the invention.
Figure 3:
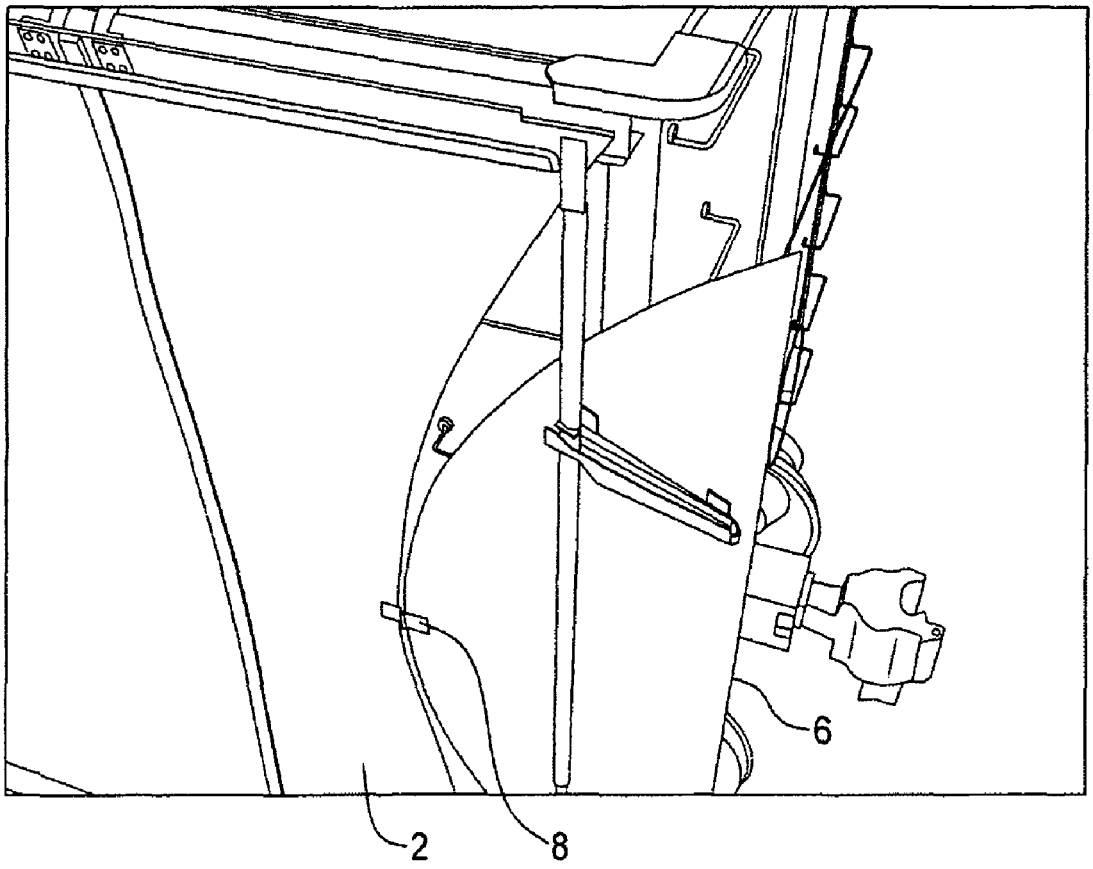
FIG. 3 is a view of the cover in a partially open position prior to separation of the edge of the rigid end section from the semi-rigid main cover section; according to a preferred embodiment of the invention.
Figure 4:
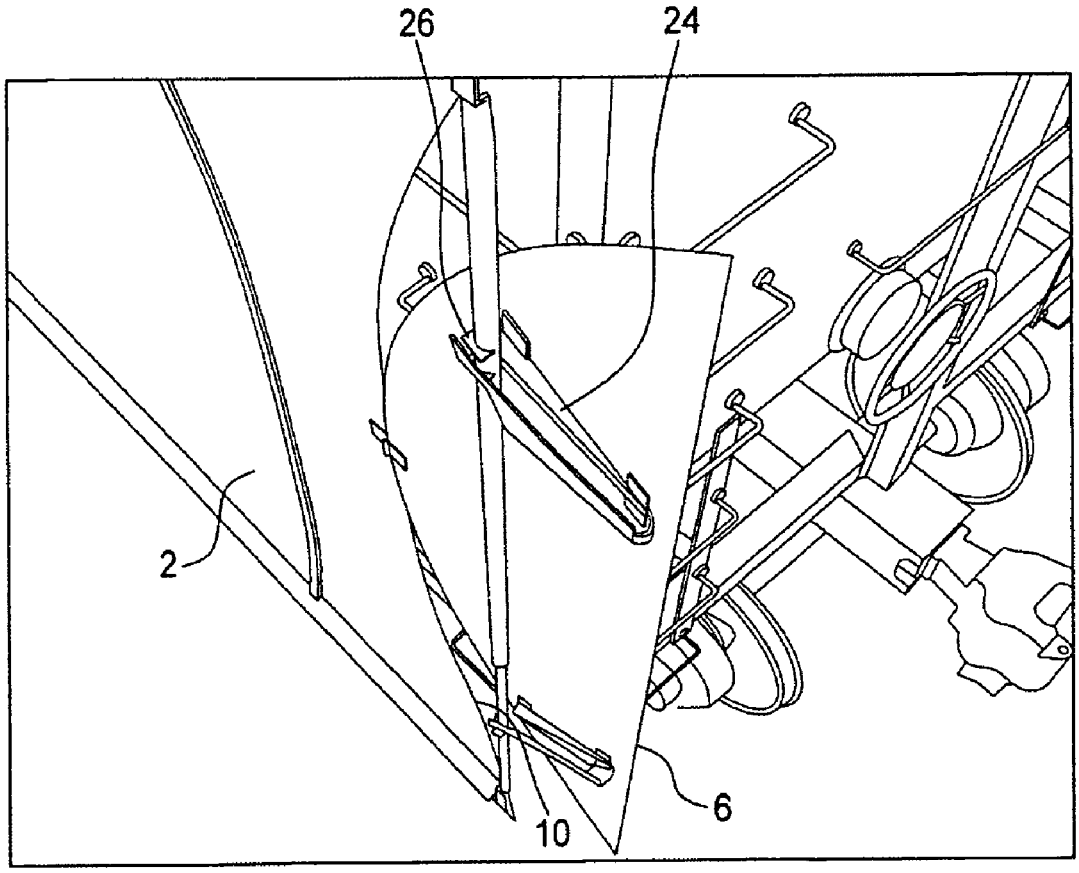
FIG. 4 is a view of the cover in a partially open position, according to a preferred embodiment of the invention.
Figure 5:
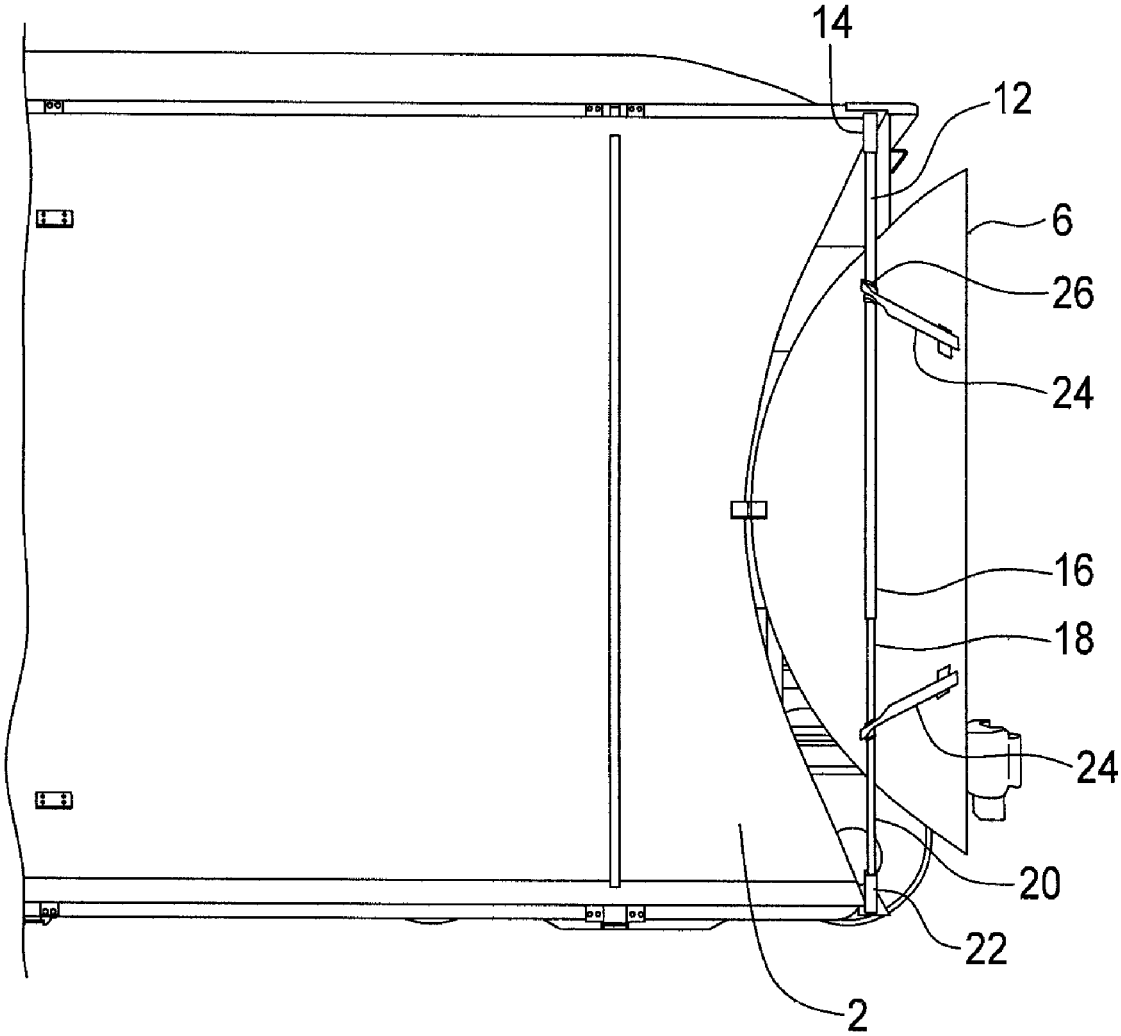
FIG. 5 is a view of the cover in a fully open position, according to a preferred embodiment of the invention.

In the drawings, one embodiment of the invention is illustrated by way of example. It is to be expressly understood that the description and drawings are only for the purpose of illustration and as an aid to understanding, and are not intended as a definition of the limits of the invention.

DETAILED DESCRIPTION OF THE INVENTION

Referring first to FIG. 1, the main cover section 2 of the railcar cover 4 consists of a single sheet of a thin fiber-reinforced composite material, of a size sufficient to span the width of the railcar, while arching up to create a curved profile, in end view, of a height sufficient to provide a degree of structural rigidity to the cover. The longitudinal sides of the main cover section are manufactured of a thicker composite material to increase edge rigidity. Along each side edge, set in from the edge, there is provided a hollow or foam-filled rib section to provide additional edge rigidity to the cover.

The remainder of the main cover section is manufactured of a thin composite material, to which are laminated a plurality of composite 'battens' for adding rigidity. Constructed of high fibre content composite materials, these ribs will be of a rigidity selected to maintain the cover in an arched shape when not compressed, yet permit compression or flattening of the cover against the side of the car when the cover is fully open. This design of the cover provides a cover which overall is much lighter than prior art covers of comparable size, even those constructed from lightweight composites.

As best shown in FIGS. 2-5, in a preferred embodiment, the end sections 6 of the cover are manufactured of a rigid material such as glass or other rigid material. Each end section is parabolic in shape to correspond to the curve defined by the end of the main cover section. To permit flattening of the cover as the cover is opened and rotated alongside the railcar, a hinge 8 connects the peak of the curve of each end section to the center of the corresponding end 10 of the main cover section, allowing the end section to be substantially separated from the end of the main cover section upon opening of the cover while remaining hingedly connected at a central position.

A cover end section guide assembly comprises a first tube 12 hinged at a first end 14 to the outer surface of one edge of one end of the main cover section, in telescopic relationship at a second end 16 to the first end 18 of a second tube 20 hinged at its second end 22 to an outer surface of an opposing edge of the corresponding end of the main cover section. The cover end section guide assembly further comprises at least one guide element 24 fixed to the internal surface of the end section. Each guide element comprises a hollow oblong cylinder which is slidable along a fixed bracket 26 on the telescopic tube assembly.

As the cover is fully rotated through its opening arc about one longitudinal edge, the main cover section may be flattened, causing separation of the curved end edges of the main cover section from the curved edge of each cover end section. As the main cover flattens, thereby drawing the edges of the main cover section apart from one another, the telescopic tube assembly is extended, causing each guide element to slide across its set position on the telescopic tube. As the distance between the center and each longitudinal edge of the main section of the cover increases, the end section is drawn away from the main cover section. Each guide element provides support to the end section as it moves from a closed position atop the railcar to a fully opened position alongside the railcar, allowing each hinged end section to lie flat, co-planar with the flattened main body section.

Figure 6:
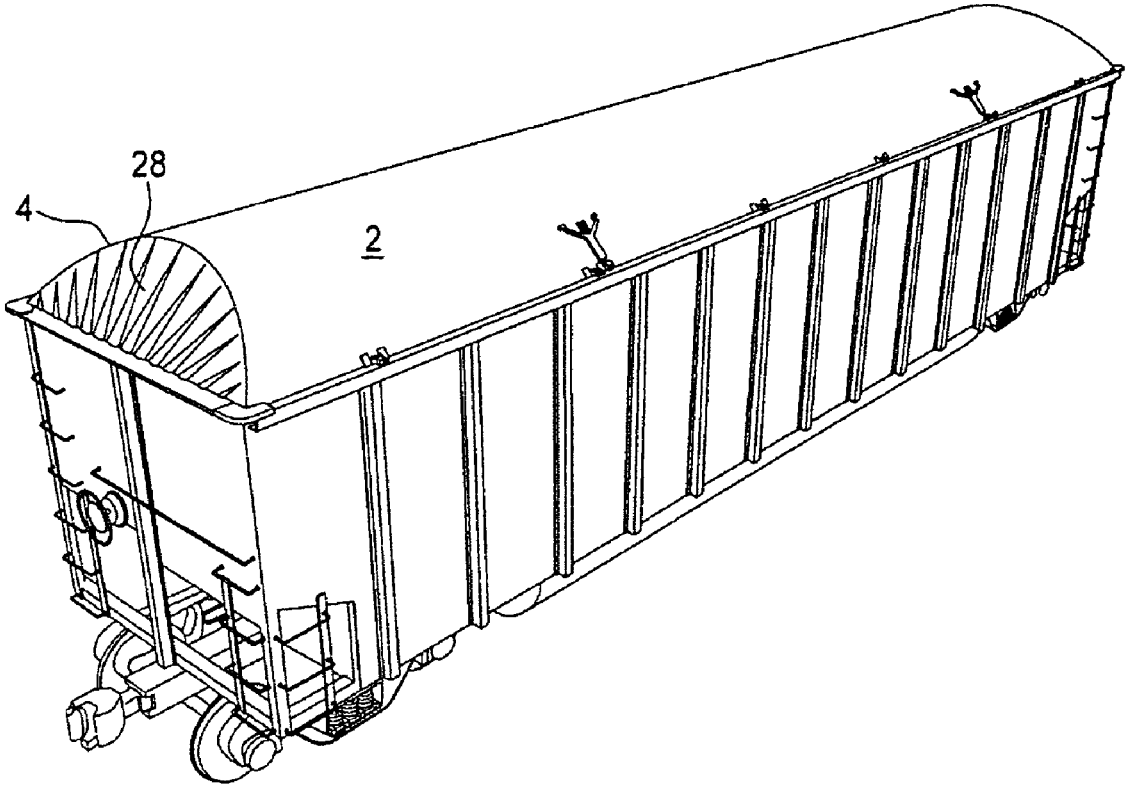
FIG. 6 is a perspective view of the cover in a closed position atop a railcar, according to an alternate embodiment of the invention.
Figure 7:
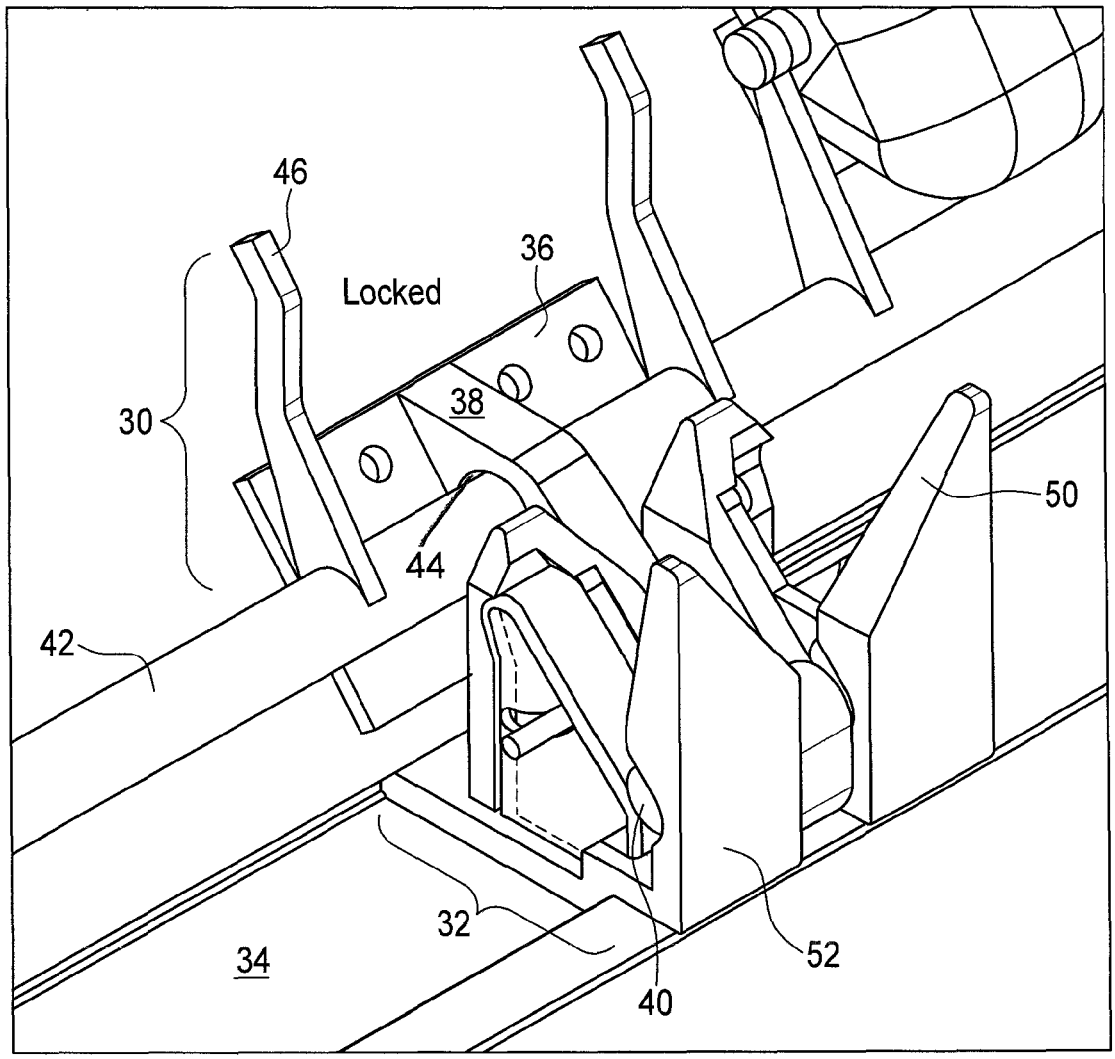
FIG. 7 is a view of the hinge in a locked position, according to a preferred embodiment of the invention.
Figure 8:
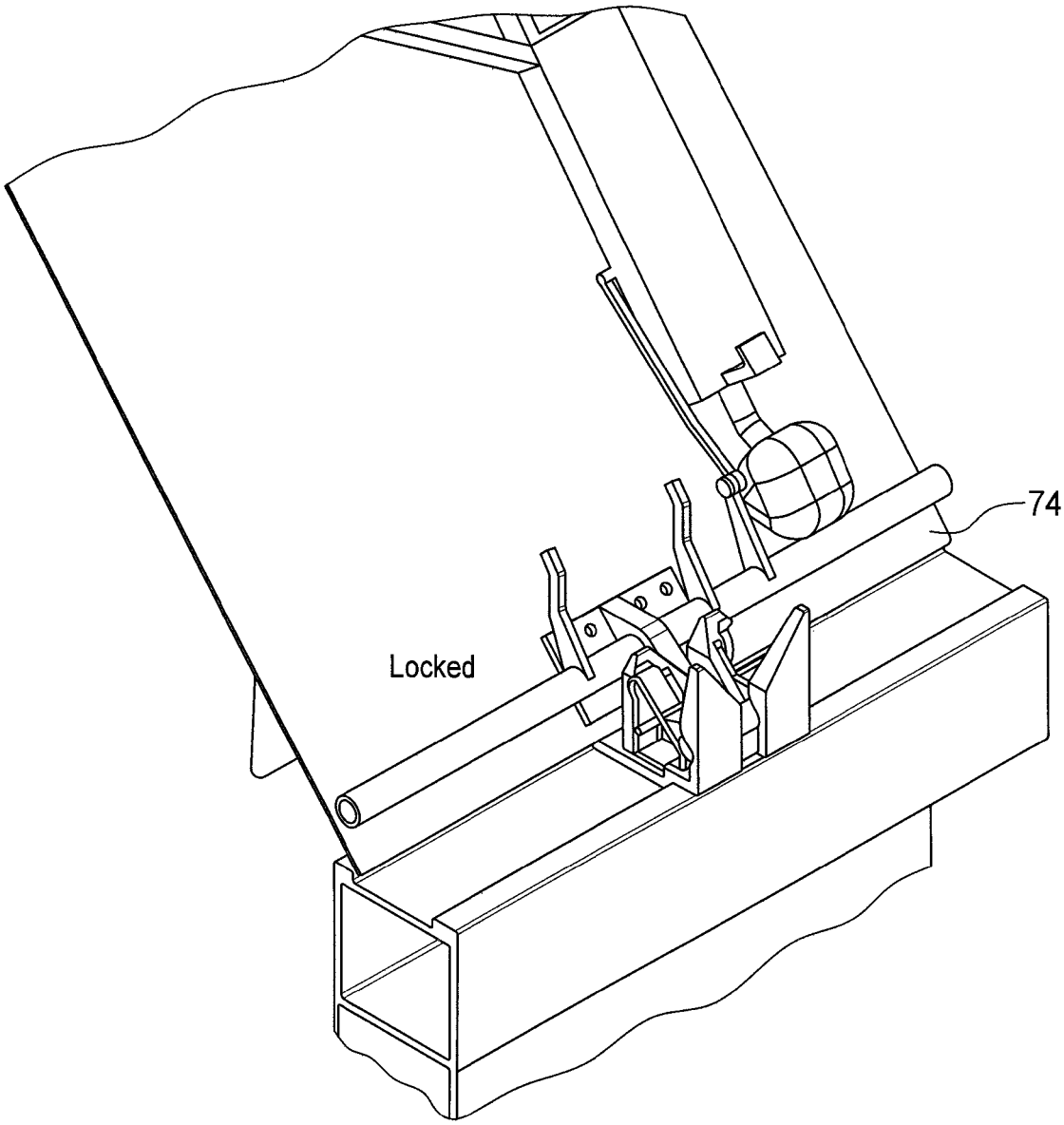
FIG. 8 is a view of the hinge in a locked position also showing a portion of the mechanical arm, according to a preferred embodiment of the invention.
Figure 9:
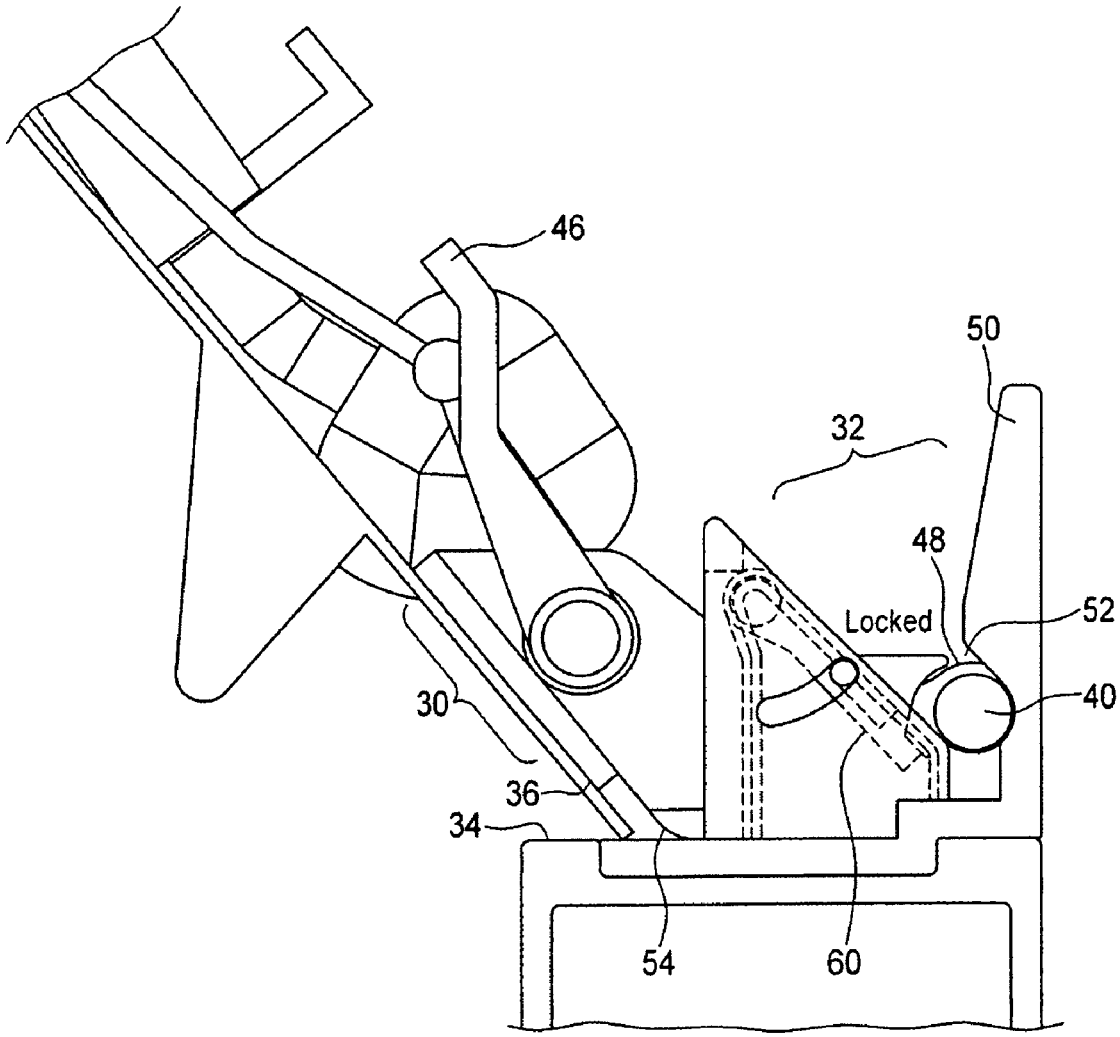
FIG. 9 is a side view of the hinge in a locked position, according to a preferred embodiment of the invention.
Figure 10:
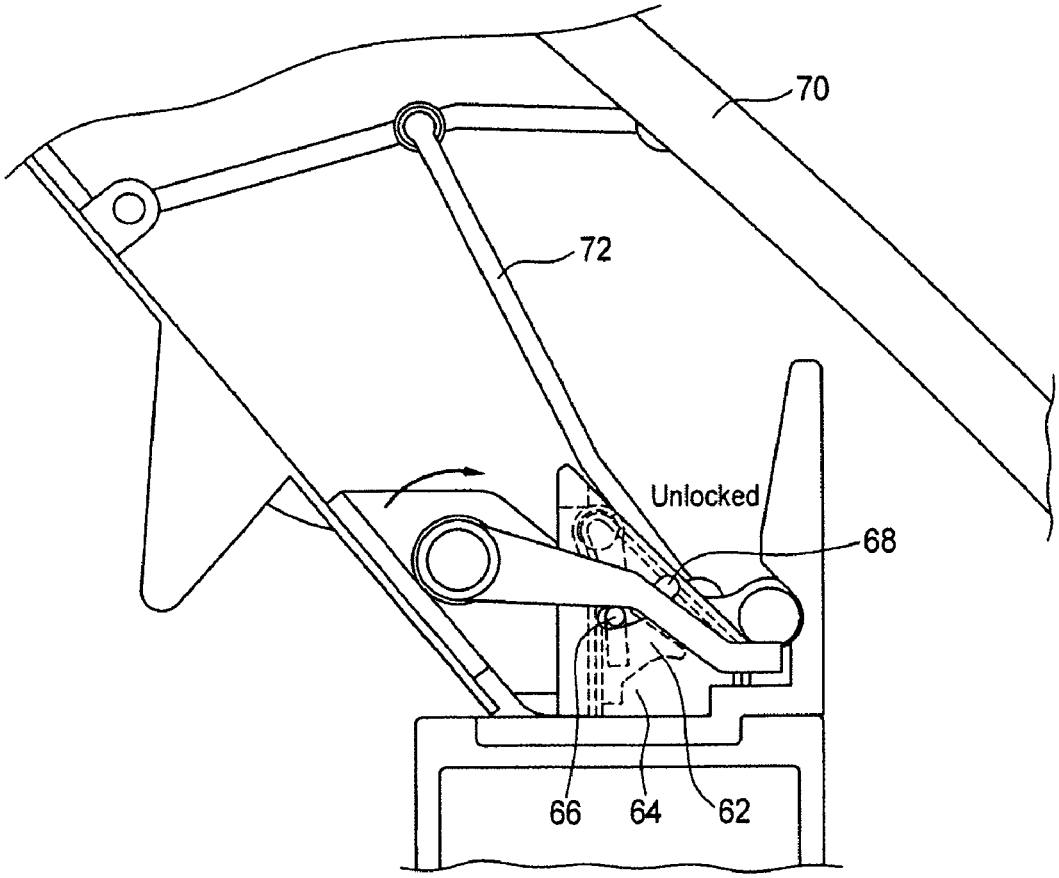
FIG. 10 is a side view of the hinge in an unlocked position, according to a preferred embodiment of the invention.
Figure 11:
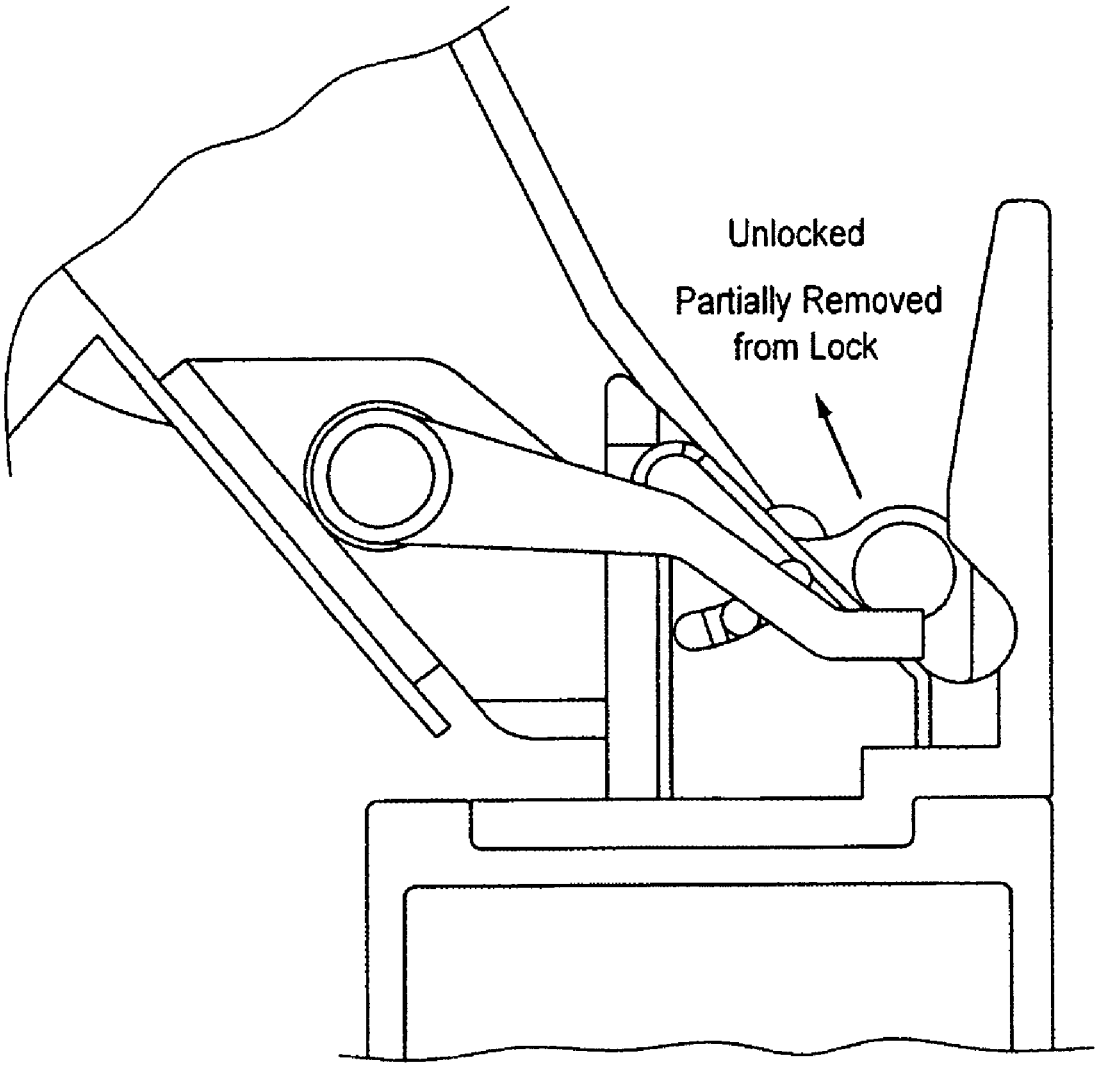
FIG. 11 is a side view of the hinge in an unlocked position showing the hinge rod partially removed from the grooves, according to a preferred embodiment of the invention.
Figure 12:
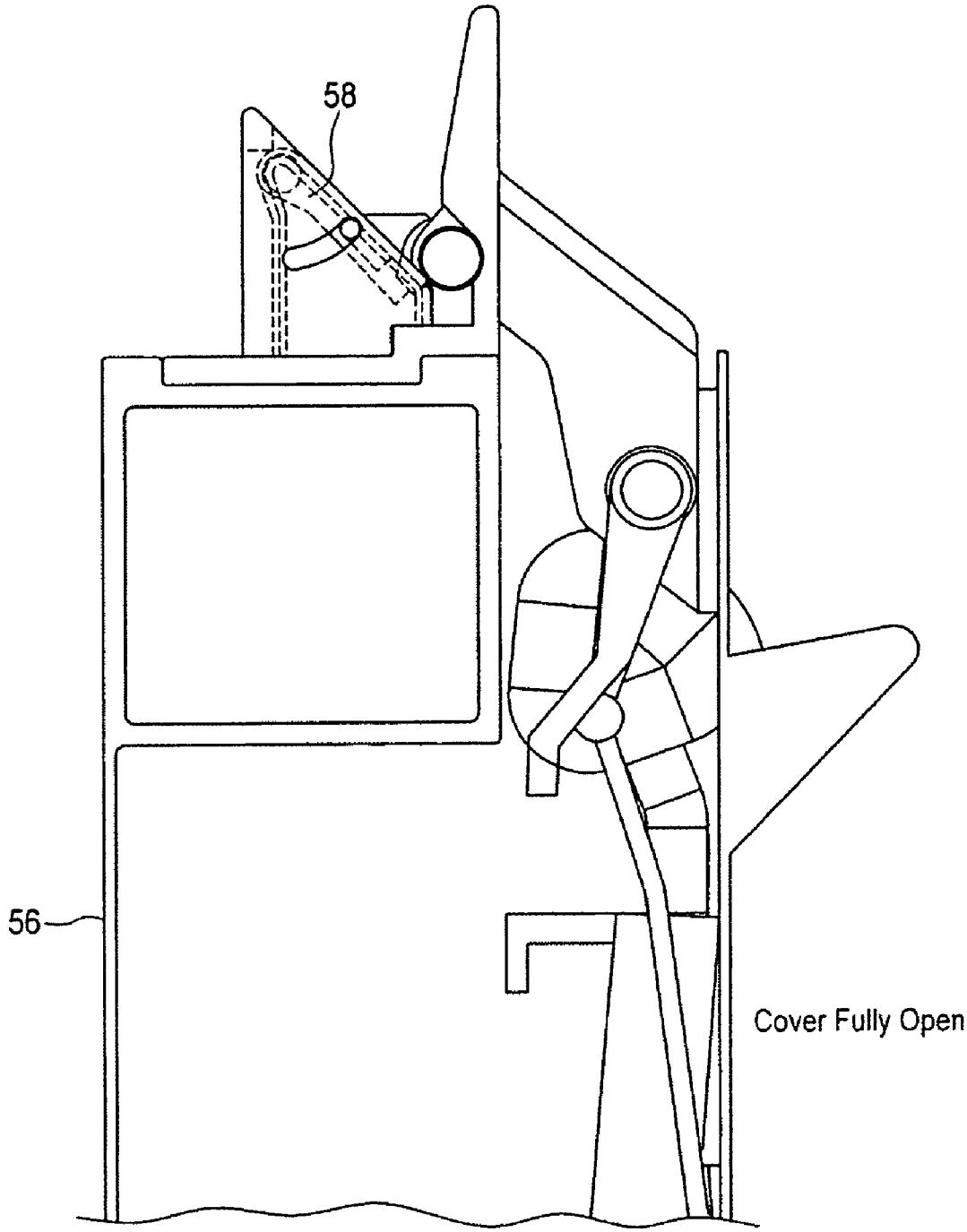
FIG. 12 is a side view of the hinge with the cover in a fully open position, according to a preferred embodiment of the invention.

In the alternate embodiment of the invention shown in FIG. 6, the ends of the cover may be manufactured of composite materials. In this embodiment, each end 28 will be produced from a flexible laminate, in a corrugated shape. As the cover is compressed or flattened, the end is required to change shape such that additional material is needed. By constructing the ends in the corrugated shape, such additional material is available. The rigidity of the composite material will pull the ends of the cover back into the corrugated shape when the cover is not compressed.

The materials used to manufacture the main section of the cover are selected such that the cover is able to support its own weight and the weight of any snow load when in a closed position, yet is capable of being bent or compressed when necessary to provide clearance in loading and unloading facilities. The telescopic tubes of the preferred end section embodiment are manufactured of fibreglass or similar lightweight rigid material.

The cover is provided with a plurality of hinges, which may be lockable hinges, or simple hinges. At least one hinge, and preferably at least two hinges, are provided on each side of the cover.

According to the preferred embodiment shown in FIGS. 7-12, each hinge consists of two sub-assemblies, a cover sub-assembly 30 associated with the cover, and a car sub-assembly 32 associated with the top sill 34 or gunnel of the railcar. The cover sub-assembly consists of one or more plates 36 attached to the external surface of the cover. A hinge arm 38 extends perpendicularly from each plate. Each hinge arm has a transverse hinge rod 40 extending generally colinearly with the top sill of the railcar. The cover sub-assembly further comprises a cylindrical rod 42 extending longitudinally along the edge of the external surface of the railcar cover through one opening or a series of openings 44 through each hinge arm. A pair of spaced hinge guides 46 extends perpendicularly to the cylindrical rod in the vicinity of each hinge. The cylindrical rod supporting the hinge guides is rotated upon opening and closing of the cover, as will be described below.

The car sub-assembly of each hinge consists of at least one hinge arm receptacle 48, each hinge arm receptacle having selectively shaped side plates 50, to guide each hinge arm and associated hinge rod into a locking position as the cover closes. When closed, the hinge rod of the cover sub-assembly sits in a pair of grooves 52 cut into each hinge arm receptacle on either side of the associated hinge arm.

When the cover is raised on one side, the shape of the sub-assemblies and their elements causes the rods on the hinge arms on the opposite side of the cover to slide into the grooves. This effectively changes the rotation point of the cover, moving the rotation point from the hinge arm shoulder 54 to the hinge rod 40, and prevents the hinge rod from moving out of the hinges. Moving the rotation point allows the cover to be rotated to a position alongside the railcar 56, below and outboard of the sill of the car.

The car sub-assembly of each hinge according to the preferred embodiment further comprises a locking element 58 pivotable between an unlocked position and a locked position on at least one of the hinges. In a locked position 60, the locking element prevents the cover from lifting up until it is unlocked. In a locked position, a flared end 62 of the locking element is positioned across the opening of the groove within which the hinge rod is sitting, preventing egress of the hinge rod. In the unlocked position 64, the locking element is rotated downwardly and inwardly to lower the flared end, thereby permitting the hinge rod to be removed from the locking, position in the groove.

Where more than one locking element is used, all locking elements may be simultaneously released, as each hinge guide extends from a common cylindrical rod. Rotation of the rod will simultaneously rotate all hinge guides attached to the rod, effecting unlocking of all locking elements on a corresponding side of the railcar.

Pivoting of the locking element is effected by mechanical pressure exerted upon a transverse pin 66 extending from one side of the locking element. The pin is in sliding engagement with a curved opening 68 in each side of the car sub-assemby block. As a mechanical arm 70 used for cover opening and closing is raised or lowered, as further described below, a lever 72 extending between the mechanical arm and a projection 74 from the cylindrical rod causes the cylindrical rod to rotate, thereby rotating the selectively shaped hinge guides into or out of position to deflect the pin of the locking element along the curved opening into or out of its locking position.

Figure 13:
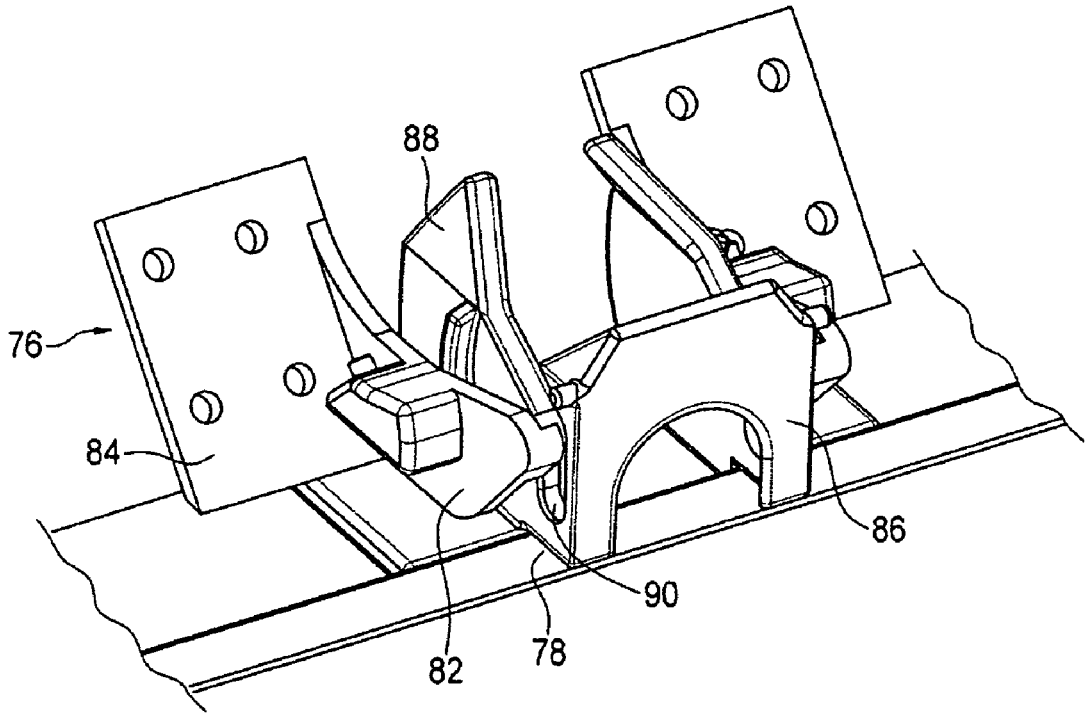
FIG. 13 is a perspective view of an alternate embodiment of a hinge showing car and cover components, according to the invention.
Figure 14:
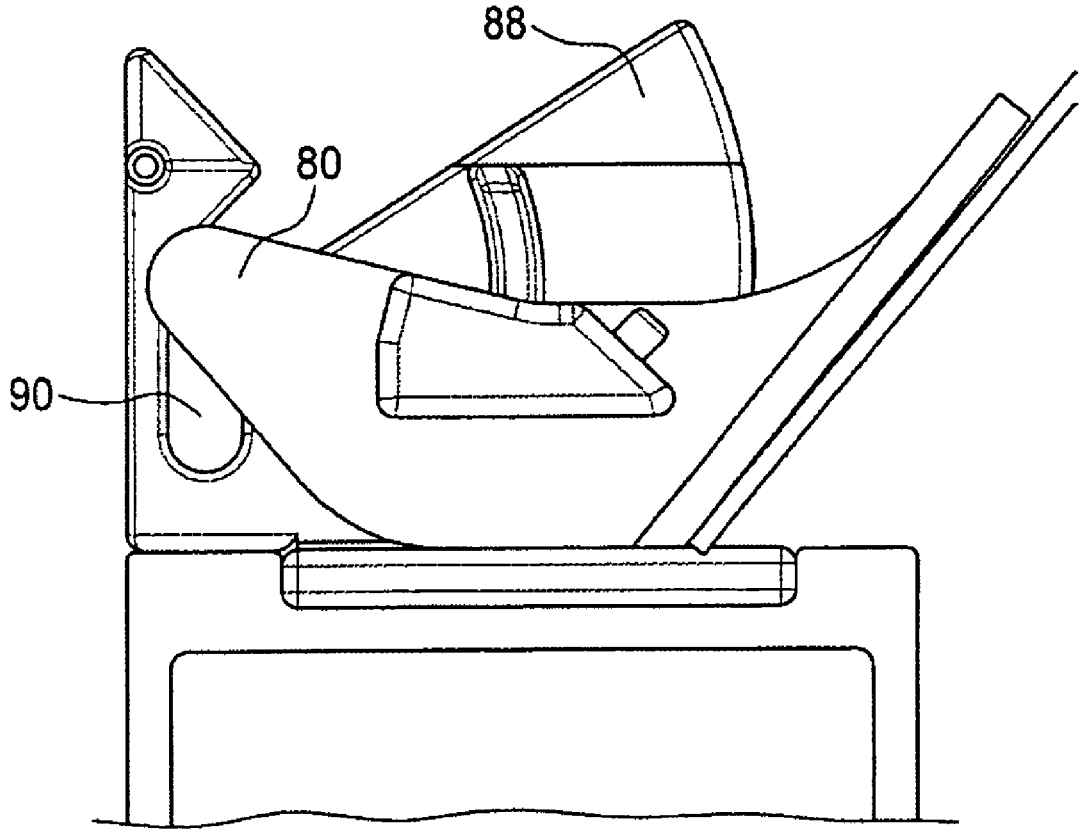
FIG. 14 is a side view of an alternate embodiment of a hinge with the cover closed, according to the invention.
Figure 15:
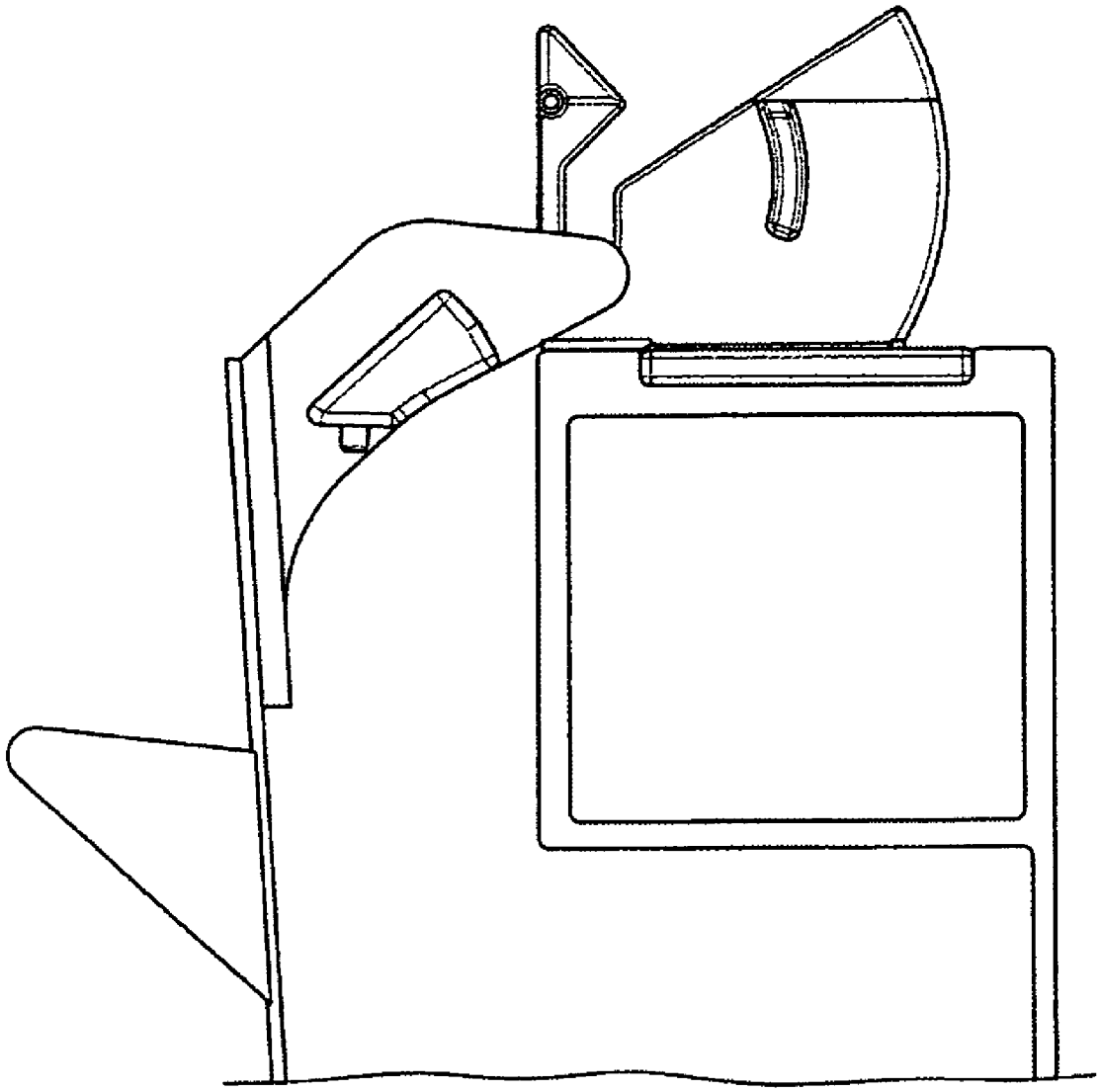
FIG. 15 is a side view of an alternate embodiment of a hinge with the cover fully open, according to the invention.

In an alternate embodiment of the present invention depicted in FIGS. 13-15, each hinge consists of two components, a cover component 76 attached permanently to the cover surface, and a car component 78 attached to the top sill or gunnel of the railcar. The cover component consists of a bar 80 which longitudinally spans the width of the car component. The bar is connected to two hinge arms 82, each perpendicular to the surface of the cover and extending approximately the full width of the car top sill, thereby straddling the car component. These hinge arms are each attached to a bolting plate 84, allowing the entire cover component to be bolted to the cover. The car component consists of a block 86 with selectively shaped side plates 88, to provide a guide for guiding the cover component into position as the cover closes. When closed, the bar on the cover component sits in a groove 90 cut into the side plates of the car component. When the cover is raised on one side, the shape of the components and their elements causes the bars on the hinges on the opposite side of the cover to slide into the grooves. This effectively changes the rotation point of the cover, to allow the cover to be rotated to a position alongside the railcar, below and outboard of the sill of the car. On at least two hinges on each side of the cover, an additional locking mechanism is provided, preventing the cover from lifting up until it is unlocked. The locking mechanism comprises a spring loaded pin on the cover component which, with the cover closed, will ride along the outside of a curved boss on the car component. Withdrawal of the pin will permit the cover to be raised and moved inboard, releasing it from the hinge. With the pin secured in place, the cover cannot be raised and remains securely confined in the hinge.

At one or more positions along the length of the cover, mechanical arms 70 are located for interaction with the helix apparatus system. Due to restrictions on railcar size, these mechanical arms must be located within the width of the railcar during travel. To allow locomotives, which are larger than gondola or hopper cars, to pass through the loading or unloading area, the helix apparatus must be outside the space occupied by the railcar. Therefore, the mechanical arms should ideally be extendible to permit engagement with the helix apparatus. In addition, the mechanical arm system should ideally be as close to the surface of the cover as possible, to allow full rotation of the cover. At a fully rotated position, the arm mechanism on the rotation axis side of the cover will be pressed between the cover and the side of the railcar.

Figure 16:
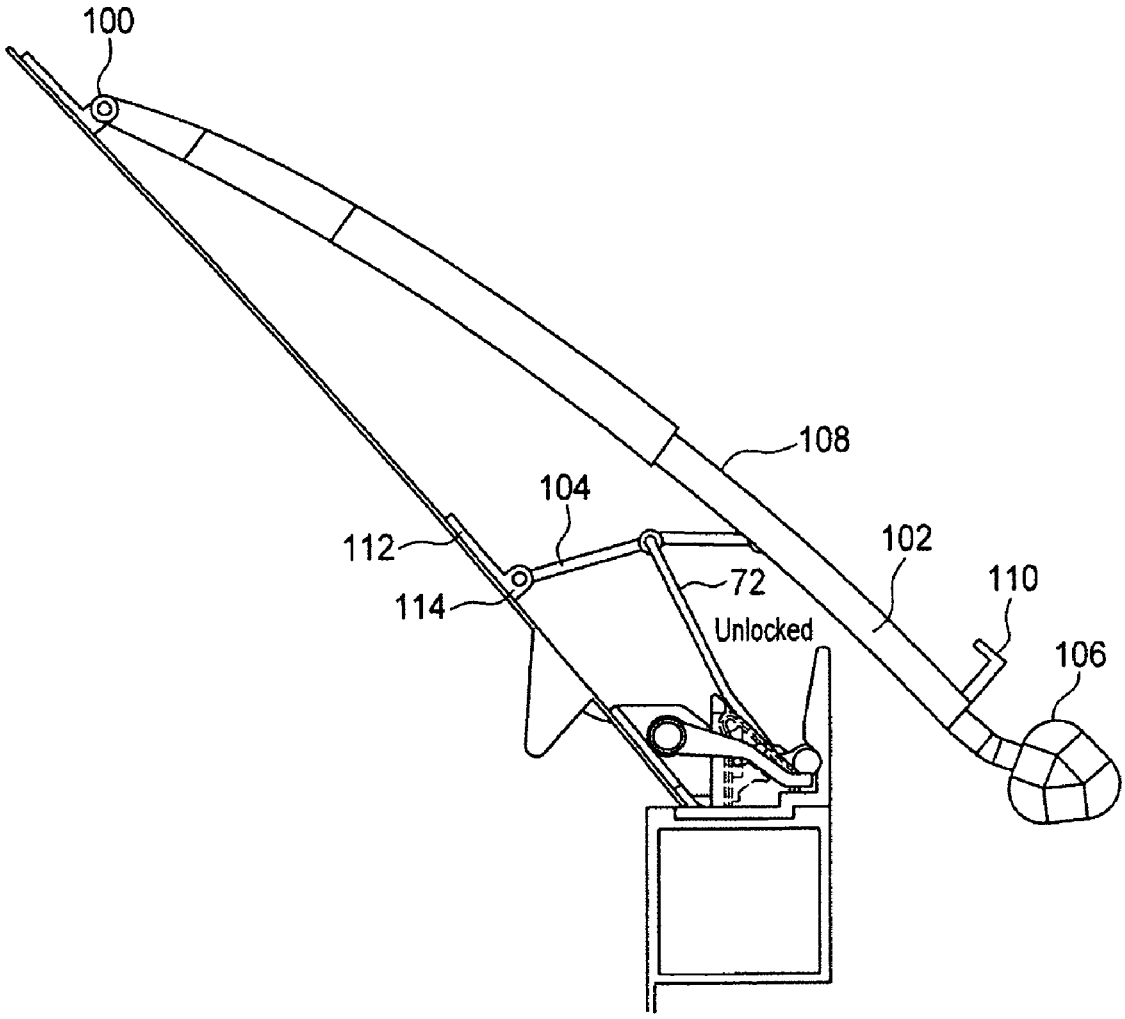
FIG. 16 is a side view of a mechanical arm, according to the preferred embodiment of the invention.
Figure 17:
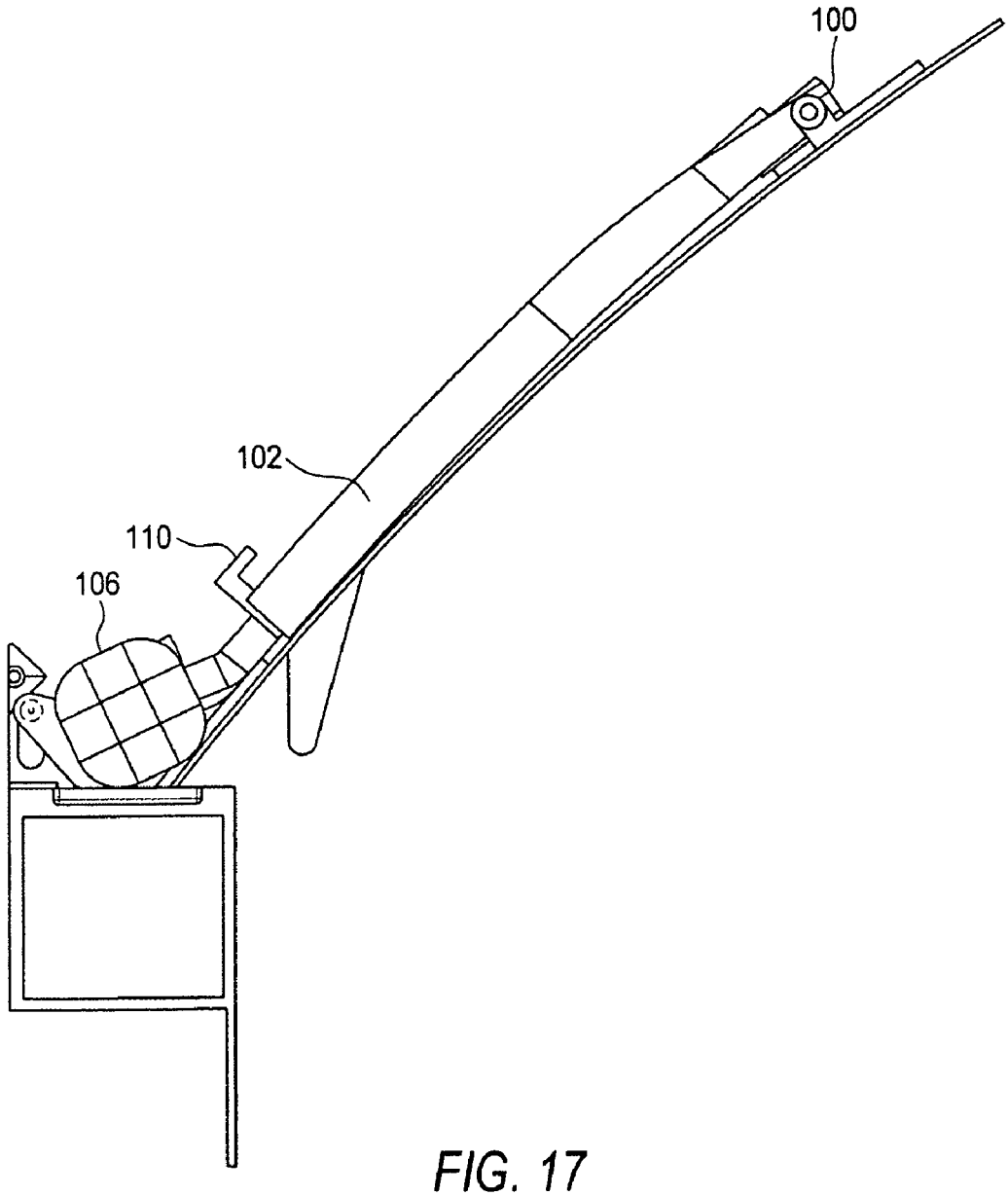
FIG. 17 is a side view of an alternate embodiment of mechanical arm in a retracted position for travel, according to the invention.
Figure 18:
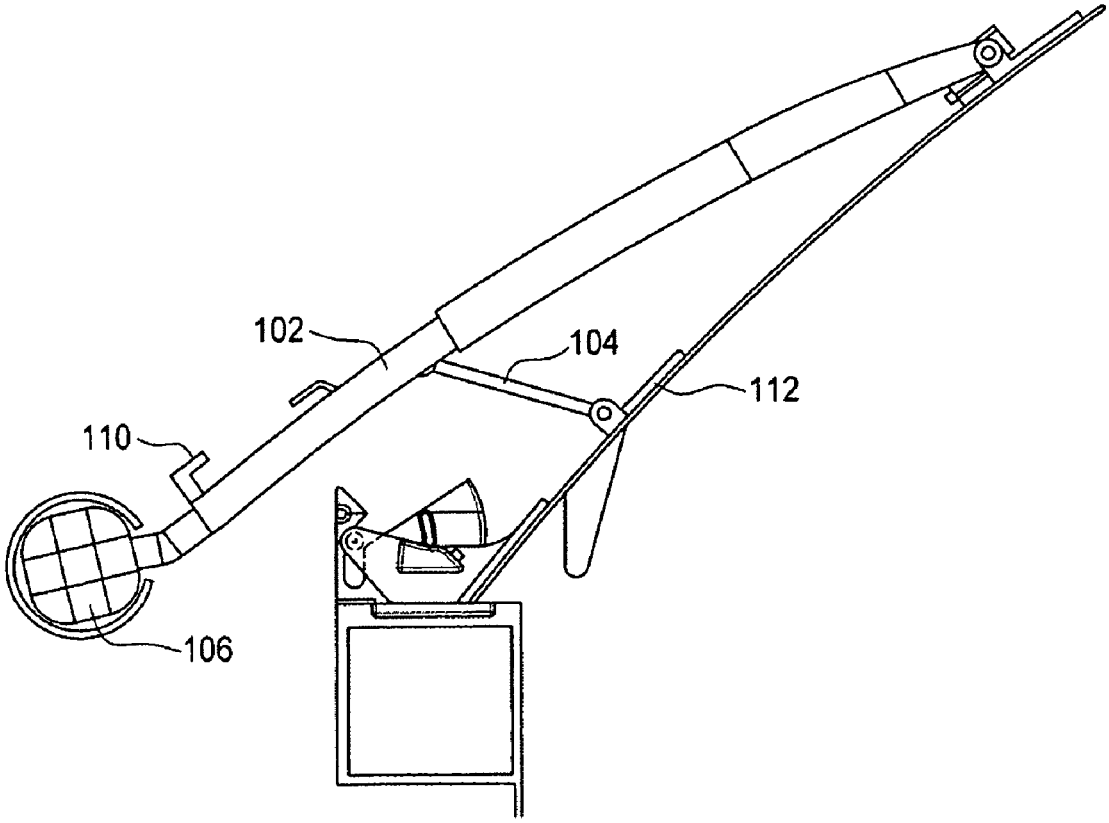
FIG. 18 is a side view of an alternate embodiment of mechanical arm extracted and engaged by the helix apparatus tube, according to the invention.
Figure 19:
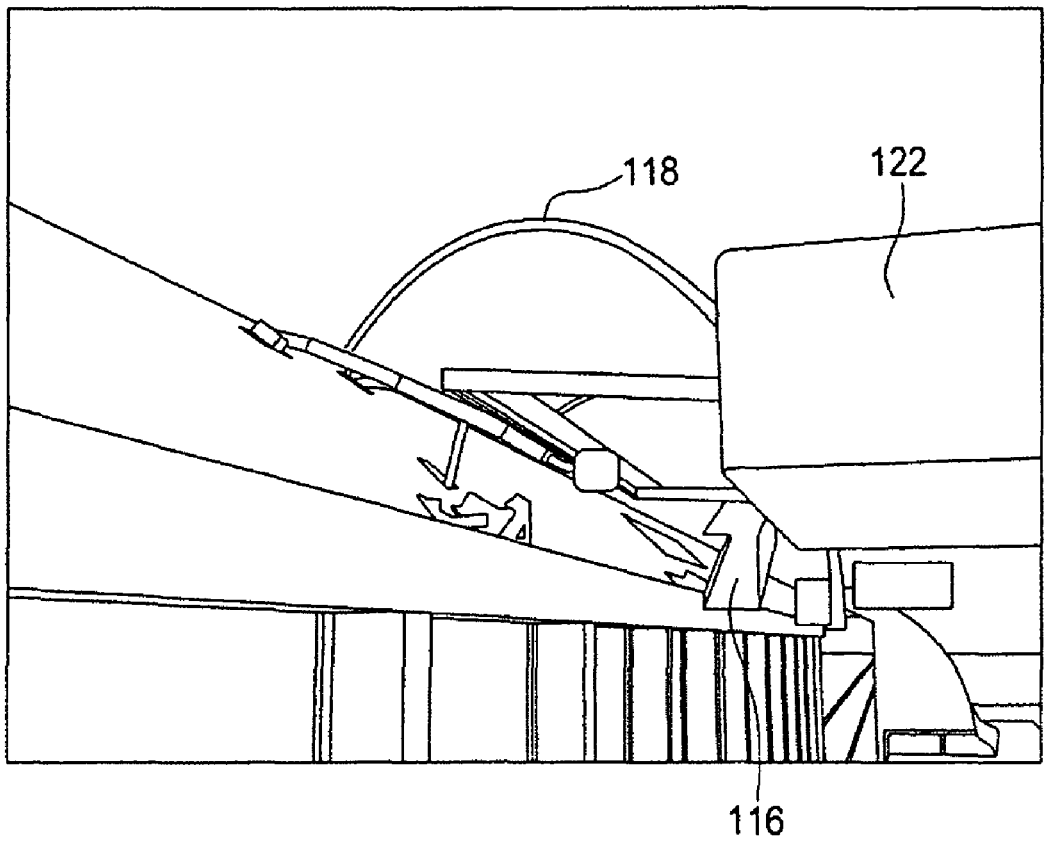
FIG. 19 is a perspective view of the arm extraction apparatus extracting a mechanical arm, according to the invention.
Figure 20:
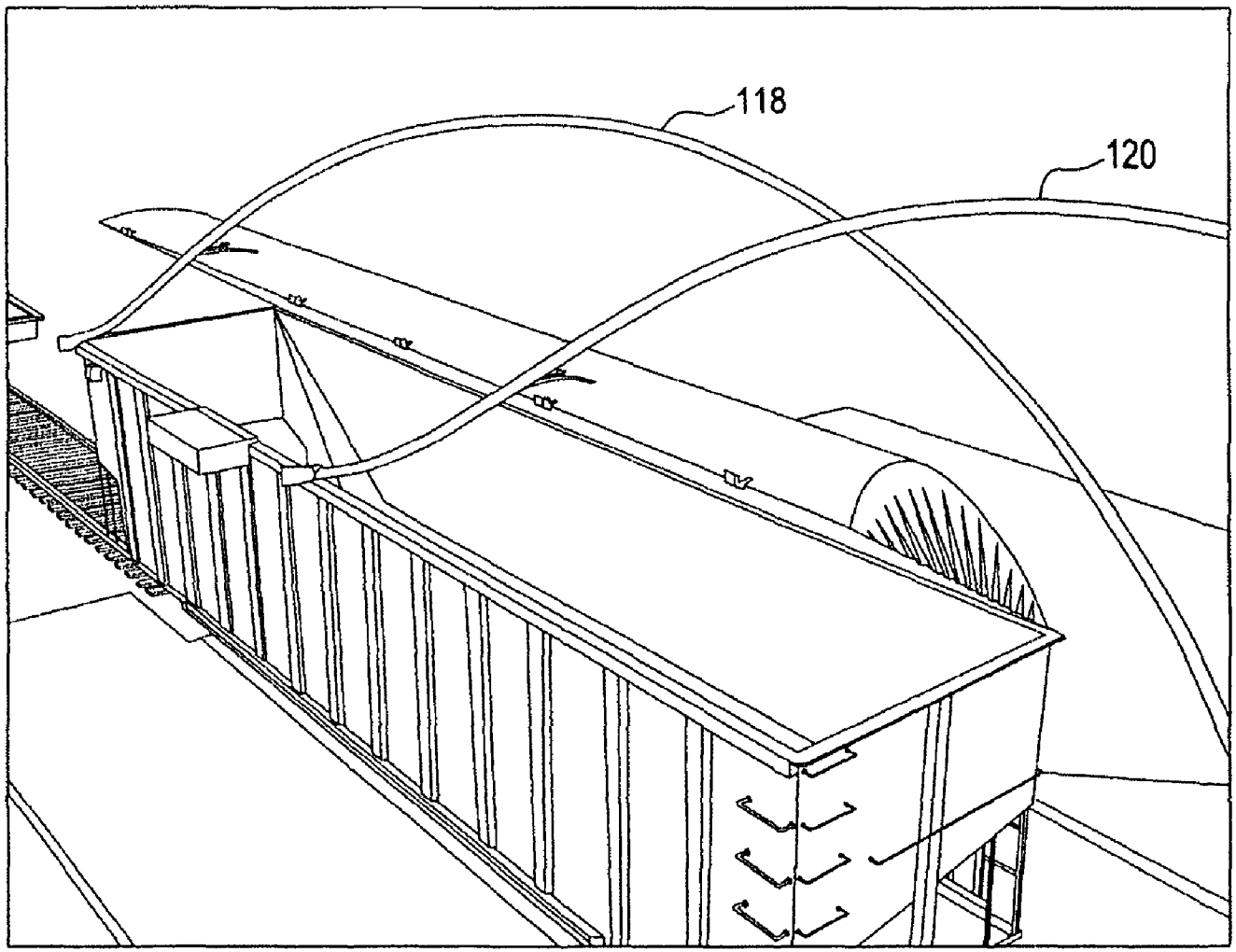
FIG. 20 is a perspective view of an alternate embodiment of the cover in a partially open position with the helix support structure removed for clarity, according to the invention.
Figure 21:
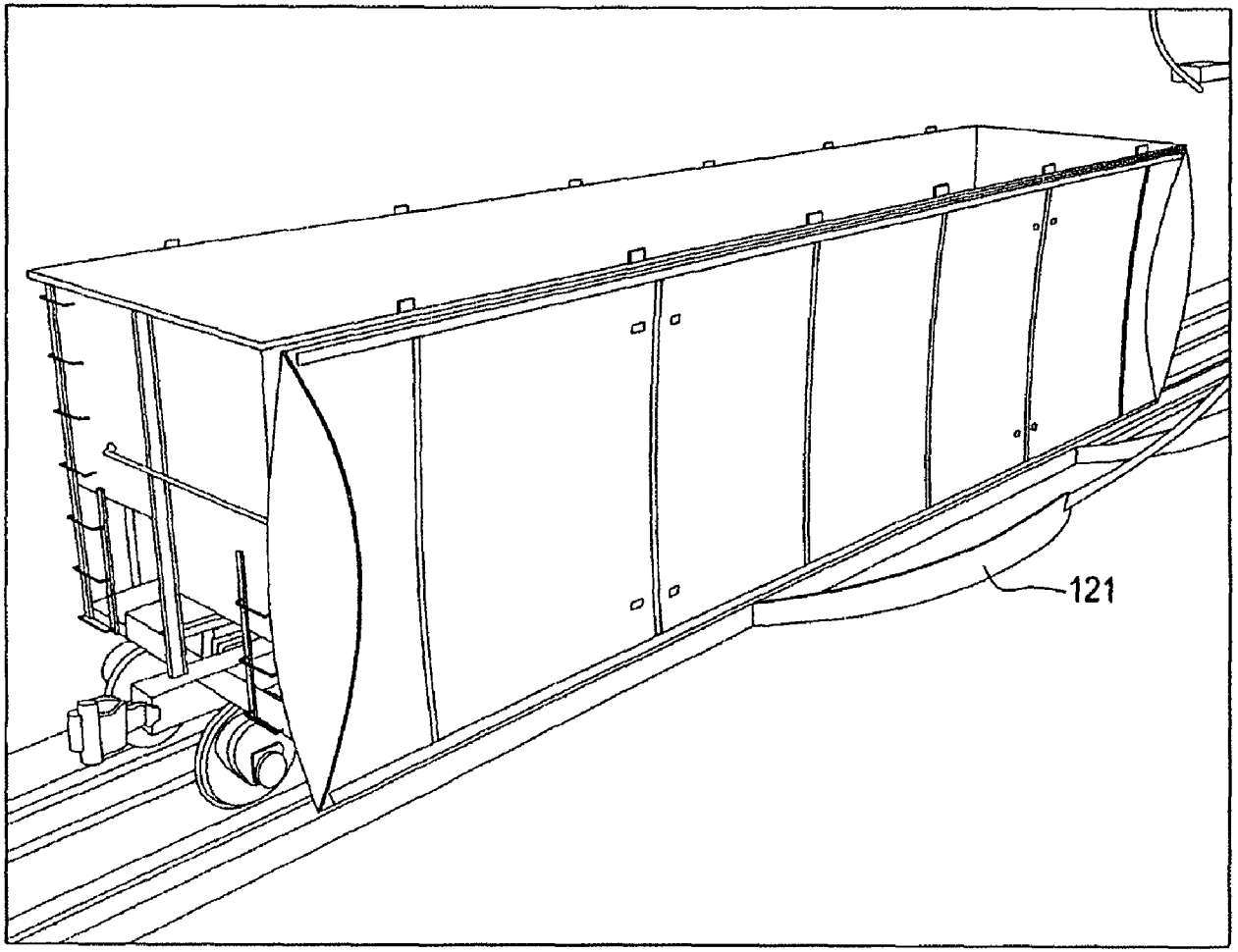
FIG. 21 is a perspective view of an alternate embodiment of the cover in fully open position and compressed against the side of a railcar, according to the invention.
Figure 22:
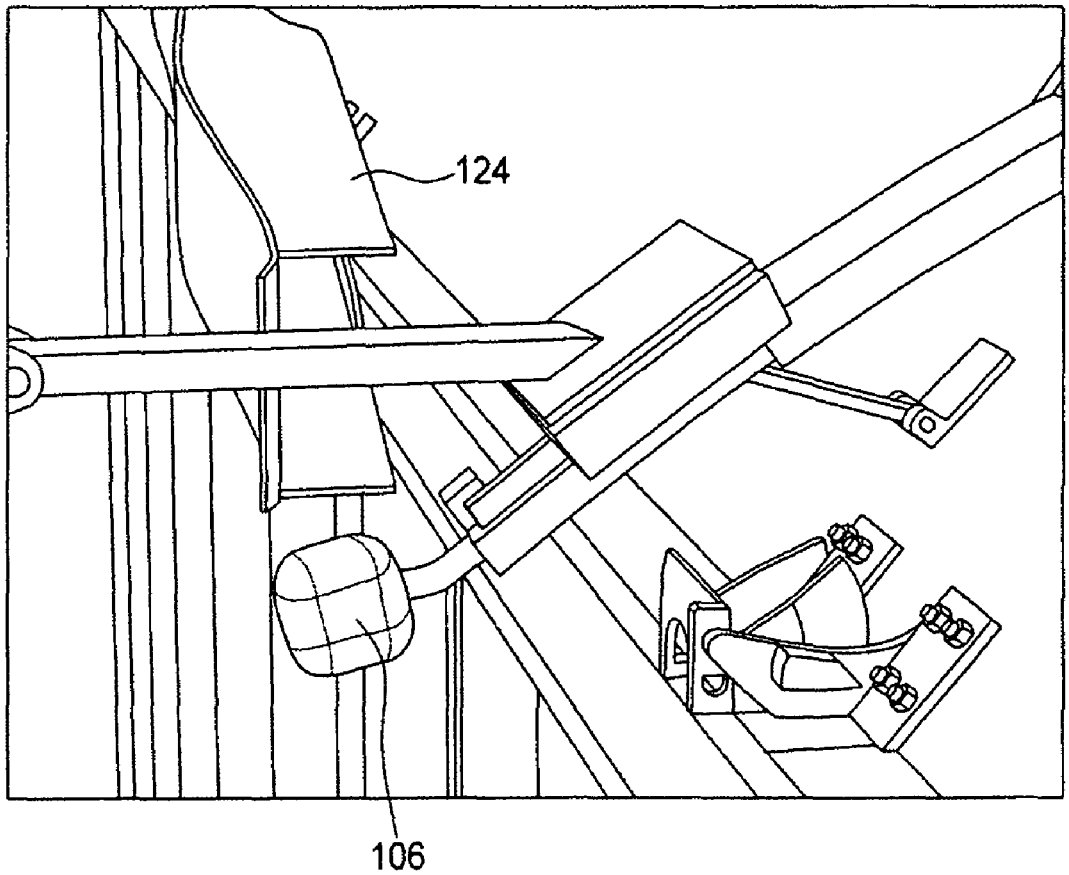
FIG. 22 is a perspective view of a spring loaded catch being released to effect retraction of mechanical arm, according to the invention.

As shown in FIGS. 16-18, the arms consist of several parts. The first part is a metal A-frame mounted on the side of the cover, pivotally mounted at the top 100 of its structure. The bottom (outside) end of the A frame is a single arm of hollow tube 102, with an opening or slot along the bottom side.

The second part of the arm is a shuttle arm 104 which slides inside the hollow tube of the 1$^{st}$ part, extending out towards the outside of the cover. The opposite end of this arm is fitted with a block 106 of low friction material such as Ultra High Molecular Weight plastic. This block is sized and shaped such that it fits inside the helix tube. On the top surface 108 of the shuttle arm, close to the outer end, there is disposed a small hook 110 facing upwardly and to the inside. This hook is engageable by the arm extracting means of the helix apparatus to permit extraction of the mechanical arm.

The third part of the mechanical arm mechanism is a support arm 112 attached to the cover below the attachment point for the A-frame, and above the inner end of the shuttle arm. The other end 114 of the support arm is attached pivotally to the bottom of the shuttle arm. In a preferred embodiment, a lever 72 extends between the support arm and a projection on the cylindrical rod of the cover sub-assembly of the hinge. When the mechanical arm is retracted for stowing, this support arm, and hinge guide lever if present, will fit inside the slot in the hollow section of the A-frame. When the arm is extracted, this support arm part will lift the mechanical arm upwardly and outwardly. Also, there is a lock mechanism, connected to the shuttle arm, which comprises a spring steel catch to lock the mechanical arm in the extracted position if desired, and which can be released when the mechanical arm is required to be returned to a retracted, 'stowed' position.

As depicted in FIGS. 19-22, the helix apparatus system consists of a capture segment, a cover opening segment, a guide segment, a cover closing segment, and a release segment.

The capture segment consists of a flared out section of tube 116, to allow for slight variations in car size and position. By ensuring that the cross-sectional area of the tube in this segment is sufficient to allow for any reasonable variations, and by sloping all sides in towards the final tube shape, the shuttle arm will be guided to the required position.

In a preferred embodiment, the cover opening segment consists of twin helical shaped tubes 118, 120, which may be metal, positioned longitudinally apart, spaced to engage shuttle arms on the cover. The guide segment consists of a planar guide 121 extending between the cover opening segment and the cover closing segment which is positioned to retain the cover between the guide and the side of the railcar. In a preferred embodiment, the cover closing segment consists of twin helical shaped tubes, positioned longitudinally apart, spaced to engage shuttle arms on the cover.

Each of the cover opening and cover closing segments of the helix apparatus consist of at least one tube, which may be metal, with a slot running its full length. The position of the slot in the tube is determined by the geometry of the cover, but basically represents a position facing toward the centre of rotation, altered by any offset in the angle to which the shuttle is mounted to its arm.

The tube is formed into a helical shape defined by the geometry of the cover and car, by the amount of space to work with, and by the speed of the train. In end view, the helix is circular, of a diameter matching the distance between the hinges and the end of the shuttle arm on the opposite side of the railcar. In plan and side view, the shape of the helix is determinable by the geometry of the cover and car, by the amount of space to work with, and by the speed of the train.

This shape determines the speed at which the cover is opened or closed, and the forces applied to the cover. Higher speeds would result in larger forces applied to the cover. As the block 106 of the shuttle arm runs within the helix tube, the tube is supportable by an external structure 122, provided that structure remains outside the curve of the helix.

The final section is a release section, which may be a flared section of helix tube 124, to release the shuttle from the tube. For an opening helix, there may not be a release segment if the intent is to hold the cover through the loading or unloading area. If the shuttle is not released, it will stay captured, and will travel through a straight section of tube before the cover is closed again.

There are several options for opening the covers; the preferred option is described here. In operation, the cover is firmly locked to the top sill of the railcar when traveling between loading and unloading facilities. In normal travel, the mechanical arms are spring loaded to a stowed position.

As the car approaches the loading or unloading site, it travels under an opening helix apparatus. First, an arm extraction apparatus extends out and engages the mechanical arms on the cover, extracting them so that the helix apparatus, which is beyond the arc of the car and cover, can capture the block at the end of the shuttle arm portion of the mechanical arm.

Various methods may be used to locate and extend the arms, without the use of power on the cover. In the preferred design a sensor, using Radio Frequency Identification (RFID) technology, senses an RFID "tag" located on the side of the cover on or near the longitudinal center of the cover. Using position sensing technology, this provides accurate positioning for the arm extraction system. This system includes an arm extraction apparatus. On a signal from the RFID system, the arm extraction apparatus extends inwardly and downwardly toward the cover, hooking a hook on the arm.

The arm extraction apparatus moves out away from the car, extracting the arm as it does so. It then raises the arm, disengaging the hook. The longitudinal length of the arm extraction apparatus is to be determined on the basis of the speed of the train. Because the train is moving while the extraction takes place, the arm extraction apparatus will move along it while the extraction occurs, and should ideally be long enough to allow that movement for the time taken to effect extraction of the mechanical arms.

Once captured, the shuttle arm travels inside the helical tube of the helix apparatus, following the helical shape while being moved forward by the train movement. This unlocks and lifts the cover on one side as the train continues to move forward.

The shape of the helical tube causes the cover to rotate about its pivot axis, a series of hinges located on the opposite side of the cover, until the entire top of the railcar is exposed. This partially open position is achieved with a cover rotation of at least 90 degrees. The cover may then be supported in this partially open position while material is loaded in the car, or it may be rotated further to a fully open position, at which position it will rest against the side of the railcar. If necessary to avoid structural components of the loading or unloading facility, the cover may be forcible compressed, by the use of an angled wall, pipe or similar deforming device along the cover's lower edge, towards the car body, flattening the cover into a smaller horizontal volume. This also allows the cover and car to fit within the envelope of a car dumper.

As the car exits the loading or unloading area, a closing helix apparatus re-engages the mechanical arms on the cover, and rotates the cover back to a closed traveling position. The final step is release of the spring loaded catches, using a trigger arm to depress the catches, allowing the springs to retract each mechanical arms back into its onboard retracted position, allowing the cars to travel to their next destination.

It will be appreciated by those skilled in the art that other variations of the preferred embodiment may also be practised without departing from the scope of the invention.

What is claimed is:

1. A cover assembly for a railcar of the type having a top opening, first and second sides and first and second side sills, the cover assembly comprising a cover having opposed side edges and rotatable through an arc of up to 270 degrees about either side edge between a closed position atop the railcar and an open position alongside a corresponding side of the railcar, wherein the cover comprises a semi-rigid, deformable main cover section, and a pair of rigid end sections, each end section hingedly attached to opposing ends of the main cover section.

2. The cover assembly of claim 1, further comprising means for reversibly opening the cover.

3. The cover assembly of claim 2, further comprising at least one first side hinge, each first side hinge comprising a cover sub-assembly and a car sub-assembly, wherein the car sub-assembly is attached to the first side top sill of the railcar for releasably and rotationally engaging the cover sub-assembly on a corresponding side of the cover.

4. The cover assembly of claim 3, further comprising at least one second side hinge, each second side hinge comprising a cover sub-assembly and a car sub-assembly, wherein the car sub-assembly is attached to the second side top sill of the railcar for releasably and rotationally engaging the cover sub-assembly on a corresponding second side of the cover.

5. The cover assembly of claim 4, wherein the cover, in its fully open position, may be compressed towards the side of the railcar.

6. The cover assembly of claim 5, wherein each end section further comprises:

a planar element having first and second faces, a straight edge and a parabolic edge;

at least two oblong hollow cylindrical guide elements fixedly attached in spaced apart relationship to the first face of the planar element;

a pair of elongated first and second tubes, the first tube hingedly connected at a first end to an edge of one end of the main cover and in telescopic relationship with a first end of a second tube, the second end of the second tube hingedly connected to a corresponding opposite edge of the corresponding end of the main cover; and a pair of guide collars, each collar attached to a tube for guiding the sliding motion of a corresponding guide element across a corresponding tube.

7. The cover assembly of claim 6, wherein maximum rotation of the cover guides each end section into a co-planar alignment with the main cover section.

8. The cover assembly of claim 5, wherein the cover, in its fully closed position, forms a dome over the top opening.

9. The cover assembly of claim 4, wherein each cover sub-assembly comprises:

a plate for attaching the cover sub-assembly to the cover;

a selectively shaped hinge arm having first and second ends, the hinge arm connected perpendicularly from a first end to the plate; and a hinge rod connected at a medial position to the second end of the hinge arm.

10. The cover assembly of claim 9, wherein each car sub-assembly comprises:

a hinge arm receptacle having a pair of selectively shaped adjacent side plates for guiding the hinge rod one or more grooves formed in the side plates, wherein each groove has an external portion for releasably retaining the cover sub-assembly at the disengaging side edge of the cover during opening and closing of the cover; and an internal portion for receiving the hinge rod into a locking position for cover rotation at the non-disengaging side edge of the cover during opening and closing of the cover.

11. The cover assembly of claim 10, further comprising a locking element having a pivoting end and a flared end, pivotal between a locking position in which the flared end is positioned adjacent the groove opening, and an unlocking position in which the flared end is positioned clear of the groove opening.

12. A cover system for open top railcars, comprising:

a semi-rigid, deformable cover having opposed rigid end sections; and means for reversibly opening the cover, wherein the means for reversibly opening the cover comprise:

at least one mechanical arm connected to at least one side edge of the cover, each arm movable between a retracted position and an extracted position and having a spring-loaded catch;

means for extracting each mechanical arm;

a track for permitting directional movement of the railcar;

a stationary helix apparatus adjacent the track for engaging each mechanical arm; and means for retracting each mechanical arm.

13. The railcar cover system of claim 12, wherein the at least one mechanical arm further comprises:

a hollow elevator arm, having a longitudinal slot, pivotally connected at a first end to the cover;

a shuttle arm slidably engaged at a first end within the second end of the elevator arm;

a block connected to a second end of the shuttle arm for engagement with the helix apparatus;

a support pivotally attached at a first end to the cover and pivotally attached at a second end to the first end of the shuttle arm; and a hinge guide lever attached at a first end to the support arm and at a second end to a projection on the cylindrical rod of the cover sub-assembly of the hinge.

14. The railcar cover system of claim 13, wherein the means for extracting each mechanical arin comprises:

a hook on each mechanical arm;

at least one U-shaped arm extraction apparatus for engagement of each hook to effect outward movement of each mechanical arm from a retracted position to an extracted position; and a radio frequency identification sensor on the helix apparatus and a radio frequency identification tag on the cover for activation of the arm extraction apparatus.

15. The railcar cover system of claim 14, wherein the helix apparatus comprises:

a capture segment;

a cover opening segment having entry and exit ends;

a guide segment;

a cover closing segment having entry and exit ends; and a release segment.

16. The railcar cover system of claim 15 wherein:

the cover opening segment further comprises at least one helical tube for engaging the at least one mechanical arm, wherein each helical tube has an entry end and a slot extending along its length and is selectively shaped on the basis of cover geometry, railcar geometry, railcar speed, and available operating space to permit full opening of the cover.

17. The railcar cover system of claim 16, wherein the cover closing segment further comprises at least one helical tube for engaging the at least one mechanical arm, wherein each helical tube has an exit end and a slot extending along its length and is selectively shaped on the basis of cover geometry, railcar geometry, railcar speed, and available operating space to permit full closing of the cover.

18. The railcar cover system of claim 17, wherein the at least one helical tube of the cover opening segment comprises only one helical tube, and the at least one helical tube of the cover closing segment comprises only one helical tube.

19. The railcar cover system of claim 18, wherein the guide segment further comprises:

a planar guide extending between the tube of the cover opening segment and the tube of the cover closing segment, a portion of the planar guide at a vertical height sufficient to engage either the block of the shuttle arm or a lower edge of the cover to retain the cover within a desired distance of the side of the railcar.

20. The railcar cover system of claim 19, wherein the at least one helical tube of the cover opening segment comprises at least two helical tubes which are parallel, and the at least one helical tube of the cover closing segment comprises at least two helical tubes which are parallel.

21. The railcar cover system of claim 20, wherein the guide segment further comprises:

a planar guide extending between each tube of the cover opening segment and a corresponding tube of the cover closing segment, a portion of the planar guide at a vertical height sufficient to engage a lower edge of the cover and retain the cover within a desired distance of the side of the railcar, the guide having:

a first opening therein in proximity to the exit end of the cover opening segment, the opening operable to permit passage through the first opening of at least one shuttle arm; and a second opening therein in proximity to the entry end of the cover closing segment, the opening operable to permit passage through the second opening of at least one shuttle arm.

22. The railcar cover system of claim 21, wherein:

the capture segment further comprises a flared section at the entry end of each tube for guiding the block of the shuttle arm into the tube.

23. The railcar cover system of claim 22, wherein the release segment further comprises a flared section at the distal end of each tube for guiding the shuttle out of the tube.

24. A method for reversibly opening a cover for an open top railcar using the helix apparatus of claim 23, comprising the steps of:

a. moving the railcar along a track to a helix apparatus entry position to effect engagement of the at least one mechanical arm on a first side edge of the cover by each helical tube of the cover opening segment;

b. moving the railcar further along the track to effect delatching of the cover from the hinges on a first side sill of the railcar;

c. moving the railcar further along the track to effect rotation of the cover by at least 90 degrees about a second side edge from a closed position atop the railcar, to a partially open position clear of the railcar opening;

d. moving the railcar further along the track alongside the planar guide to maintain the rotational position of the cover during loading or unloading of the railcar;

e. moving the railcar further along the track to effect reverse rotation of the cover about the second side edge from the partially open position clear of the railcar opening to a closed position atop the railcar;

f. moving the railcar further along the track to effect latching of the cover to the hinges on the first side sill of the railcar; and g. moving the railcar further along the track to a helix exit position to effect disengagement of the at least one mechanical arm on the first side edge of the cover from each helical tube of the cover closing segment.

25. The method for reversibly opening a cover for an open top railcar using the helix apparatus of claim 24, further comprising the additional steps:

after step c. of:

c.1. moving the railcar further along the track to effect rotation of the cover about the second side edge from a partially open position clear of the railcar opening to a fully open position alongside the railcar; and after step d. of:

d.1. moving the railcar further along the track to effect reverse rotation of the cover about the second side edge from the fully open position alongside the railcar to the partially open position clear of the railcar opening.

26. The method for reversibly opening a cover for an open top railcar using the helix apparatus of claim 25, further comprising the additional steps:

after step c.1. of:

c.2. moving the railcar further along the track along a deforming apparatus to effect transition of the cover from an arched formation alongside the railcar to a compressed formation alongside the railcar; and after step d.1. of:

d.2. moving the railcar further along the track beyond a deforming apparatus to effect transition of the cover from a compressed formation alongside the railcar to an arched formation alongside the railcar.

27. A method for reversibly opening a cover for an open top railcar using the helix apparatus of claim 23, comprising the steps of:

a. moving the railcar along a track to a helix apparatus entry position to effect engagement of the at least one mechanical arm on a first side edge of the cover by each helical tube of the cover opening segment;

b. moving the railcar further along the track to effect delatching of the cover from the hinges on a first side sill of the railcar;

c. moving the railcar further along the track to effect rotation of the cover by at least 90 degrees about a second side edge from a closed position atop the railcar, to a partially open position clear of the railcar opening;

d. moving the railcar further along the track to effect reverse rotation of the cover about the second side edge from the partially open position clear of the railcar opening to a closed position atop the railcar;

e. moving the railcar further along the track to effect latching of the cover to the hinges on the first side sill of the railcar; and f. moving the railcar further along the track to a helix exit position to effect disengagement of the at least one mechanical arm on the first side edge of the cover from each helical tube of the cover closing segment.

28. The method for reversibly opening a cover for an open top railcar using the helix apparatus of claim 27, further comprising the additional steps after step c. of:

c.1. moving the railcar further along the track to effect rotation of the cover about the second side edge from a partially open position clear of the railcar opening to a fully open position alongside the railcar; and c.2 moving the railcar further along the track to effect reverse rotation of the cover about the second side edge from the fully open position alongside the railcar to the partially open position clear of the railcar opening.

29. The method for reversibly opening a cover for an open top railcar using the helix apparatus of claim 28, further comprising the additional steps after step c.1. of:

c.1.1. moving the railcar further along the track along a deforming apparatus to effect transition of the cover from an arched formation alongside the railcar to a compressed formation alongside the railcar; and c.1.2. moving the railcar further along the track beyond a deforming apparatus to effect transition of the cover from a compressed formation alongside the railcar to an arched formation alongside the railcar.

30. The method for reversibly opening a cover for an open top railcar using the helix apparatus of claim 27, further comprising the additional steps after step c. of:

c.1. moving the railcar further along the track to a helix exit position to effect disengagement of each mechanical arm on the first side edge of the cover from each corresponding helical tube of the cover opening segment; and c.2. moving the railcar further along the track to a helix entry position to effect engagement of each mechanical arm on a first side edge of the cover by each corresponding helical tube of the cover closing segment.

31. The method for reversibly opening a cover for an open top railcar using the helix apparatus of claim 30, further comprising the additional steps after step c.1. of:

c.1.1. moving the railcar further along the track to a helix exit position to effect disengagement of the mechanical arms on the first side edge of the cover from each corresponding helical tube of the cover opening segment; and c.1.2. moving the railcar further along the track to a helix entry position to effect engagement of the mechanical arms on a first side edge of the cover by each corresponding helical tube of the cover closing segment.

32. The method for reversibly opening a cover for an open top railcar using the helix apparatus of claim 31, further comprising the additional steps after step c.1.1. of:

c.1.1.1. moving the railcar further along the track to a helix exit position to effect disengagement of the mechanical arms on the first side edge of the cover from each corresponding helical tube of the cover opening segment; and c.1.1.2. moving the railcar further along the track to a helix entry position to effect engagement of the mechanical arms on a first side edge of the cover by each corresponding helical tube of the cover closing segment.

33. A method for loading an open top railcar, comprising the method of claim 27 and the additional step of loading the railcar between the cover opening series of steps and the cover closing series of steps.

34. A method for unloading an open top railcar, comprising the method of claim 27 and the additional step of unloading the railcar between the opening series of steps and the cover closing series of steps.

* * * * *